US011040395B2

(12) United States Patent
Li et al.

(10) Patent No.: US 11,040,395 B2
(45) **Date of Patent: *Jun. 22, 2021**

(54) NANOSTRUCTURE SELF-DISPERSION AND SELF-STABILIZATION IN MOLTEN METALS

(71) Applicant: THE REGENTS OF THE UNIVERSITY OF CALIFORNIA, Oakland, CA (US)

(72) Inventors: Xiaochun Li, Manhattan Beach, CA (US); Jiaquan Xu, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 194 days.

This patent is subject to a terminal disclaimer.

(21) Appl. No.: 16/090,130

(22) PCT Filed: Mar. 30, 2017

(86) PCT No.: PCT/US2017/025175

§ 371 (c)(1),
(2) Date: Sep. 28, 2018

(87) PCT Pub. No.: WO2017/173163

PCT Pub. Date: Oct. 5, 2017

(65) Prior Publication Data

US 2019/0111478 A1 Apr. 18, 2019

Related U.S. Application Data

(60) Provisional application No. 62/316,274, filed on Mar. 31, 2016.

(51) Int. Cl.
*B22F 1/00* (2006.01)
*C22C 1/10* (2006.01)
(Continued)

(52) U.S. Cl.
CPC ..... *B22F 1/0025* (2013.01); *B22F 1/0018* (2013.01); *C22C 1/1036* (2013.01);
(Continued)

(58) Field of Classification Search
CPC .... B22F 1/0022; B22F 1/0018; B22F 1/0025; C22C 1/06; C22C 1/1036; C22C 32/0036; C22C 32/0063; C22C 32/0073
See application file for complete search history.

(56) References Cited

U.S. PATENT DOCUMENTS 6,251,159 B1 6/2001 Angeliu et al.
10,513,759 B2 * 12/2019 Li ..... C22C 23/04
(Continued)

FOREIGN PATENT DOCUMENTS

CN 1388085 A 1/2003
CN 1641055 A 7/2005
(Continued)

OTHER PUBLICATIONS

Extended European Search Report issued in EP 17776705.0 dated Oct. 21, 2019, 9 pages.
(Continued)

*Primary Examiner* — Scott R Kastler
(74) *Attorney, Agent, or Firm* — Foley & Lardner LLP

(57) ABSTRACT

A metal matrix nanocomposite includes: 1) a matrix including one or more metals; and 2) nanostructures uniformly dispersed and stabilized in the matrix at a volume fraction, including those greater than about 3% of the nanocomposite.

33 Claims, 13 Drawing Sheets

(51) Int. Cl.

| | |
|---|---|
| ***C22C 32/00*** | (2006.01) |
| ***C22C 33/02*** | (2006.01) |
| ***C22C 21/06*** | (2006.01) |
| *C22C 49/14* | (2006.01) |
| *C22C 47/08* | (2006.01) |

(52) U.S. Cl.

CPC ..... *C22C 21/06* (2013.01); *C22C 32/0036* (2013.01); *C22C 32/0052* (2013.01); *C22C 32/0063* (2013.01); *C22C 32/0073* (2013.01); *C22C 33/0264* (2013.01); *B22F 2001/0033* (2013.01); *C22C 47/08* (2013.01); *C22C 49/14* (2013.01)

(56) References Cited

U.S. PATENT DOCUMENTS

| | | | | |
|---|---|---|---|---|
| 2004/0016318 | A1 | 1/2004 | Angeliu | |
| 2009/0162574 | A1 | 6/2009 | Li et al. | |
| 2010/0038595 | A1* | 2/2010 | Imholt ..... | F42B 15/34 252/478 |

FOREIGN PATENT DOCUMENTS

| | | | |
|---|---|---|---|
| CN | 102046531 | A | 5/2011 |
| CN | 102149845 | A | 8/2011 |
| DE | 10 2007 044 565 | A1 | 4/2009 |
| JP | 51-087106 | | 7/1976 |
| JP | 11-502570 | | 3/1999 |
| WO | WO-96/30550 | A1 | 10/1996 |

OTHER PUBLICATIONS

Li et al, "Wetting of Ceramic Materials by Liquid Silicon, Aluminum and Metallic Melts Containing Titanium and Other Reactive Elements: A Review", Ceramics International, vol. 20, No. 6, Jan. 1, 1994, pp. 391-412.

Xu et al., "Paper; Theoretical study and pathways for nanoparticle capture during solidification of metal melt", Journal of Physics: Condensed Matter, vol. 24, No. 25, May 28, 2012, 255304, 10 pages.

First Office Action and Search Report issued in CN Application No. 201780020325.8 dated Jul. 18, 2019, 15 pages.

Chen, L-Y. et al. (2013) "Achieving uniform distribution and dispersion of a high percentage of nanoparticles in metal matrix nanocomposites by solidification processing," Scripta Materialia 69:634-637.

Goujon, C. et al. (2001) "Solid state sintering and high temperature compression properties of Al-alloy5000/A1N nanocomposites," Materials Science and Engineering A315:180-188.

Marques, M.T. et al. (2005) "Production of copper-niobium carbide nanocomposite powders via mechanical alloying," Materials Science and Engineering A 399:382-386.

Xu, J. (2015) "Achieving uniform nanoparticle dispersion in metal matrix nanocomposites," University of California, Los Angeles, Doctor of Philosophy in Materials Science and Engineering, Proquest No. 3738345.

Yazovskikh, K.A. et al. (2014) "Mechanosynthesis of Fe—NbC nanocomposite," Journal of Alloys and Compounds 586:S65-S67.

International Search Report and Written Opinion (ISA/KR) in International Application No. PCT/US2017/025175, dated Jun. 15, 2017.

Communication pursuant to Rules 70(2) and 70a(2) EPC issued in EP 17776705.0 dated Nov. 8, 2019, 1 page.

Second Office Action issued in CN Application No. 201780020325.8 dated Dec. 13, 2019, 11 pages.

Communication pursuant to Article 94(3) EPC for EP 17776705.0 dated Jun. 29, 2020.

Foreign Office Action on CN 201780020325.8 dated Aug. 6, 2020.

A. Fadavi Boostani, et al., "Graphene tweaking Hamaker constant of SiC nanoparticles: A new horizon to solve the conflict between strengthening and toughening", Scripta Materialia, vol. 118, 2016, pp. 65-69.

Notice of Reasons for Refusal on JP 2018-550516 dated Mar. 2, 2021.

Rejection Decision on CN 201780020325.8 dated Mar. 4, 2021.

Foreign Action other than Search Report on EP 17776705.0 dated Apr. 29, 2021, 7 pages.

* cited by examiner

NANOSTRUCTURE SELF-DISPERSION AND SELF-STABILIZATION IN MOLTEN METALS

CROSS-REFERENCE TO RELATED APPLICATION

This application is a national stage entry under 35 U.S.C. § 371 of International Application No. PCT/US2017/025175, filed Mar. 30, 2017, which claims the benefit of U.S. Provisional Application No. 62/316,274, filed Mar. 31, 2016, the content of each of which is incorporated herein by reference in its entirety.

STATEMENT REGARDING FEDERALLY SPONSORED RESEARCH OR DEVELOPMENT

This invention was made with Government support under 1449395, awarded by the National Science Foundation. The Government has certain rights in the invention.

TECHNICAL FIELD

This disclosure generally relates to nanocomposites, such as nanocomposites including nanoparticles dispersed in a metal matrix.

BACKGROUND

Metal matrix nanocomposites, also sometimes referred to as nanostructure reinforced metal, is an emerging class of materials exhibiting desirable properties including mechanical, electrical, thermal, and chemical properties. It can be very difficult to disperse nanostructures uniformly due to their large surface-to-volume ratios and poor wettability in a metal matrix, and this difficulty in achieving a uniform nanostructure dispersion has hindered the development of metal matrix nanocomposites for various applications.

It is against this background that a need arose to develop the embodiments described herein.

SUMMARY

In one aspect according to some embodiments, a metal matrix nanocomposite includes: 1) a matrix including one or more metals (or one or more metal elements); and 2) nanostructures uniformly dispersed and stabilized in the matrix at a volume fraction, including those greater than about 3% of the nanocomposite.

In some embodiments, the matrix includes one or more metals selected from, for example, Al, Mg, Fe, Ag, Cu, Mn, Ni, Ti, Cr, Co, and Zn.

In some embodiments, the nanostructures have an average dimension in a range of about 1 nm to about 100 nm. In some embodiments, the nanostructures have an average dimension greater than about 100 nm.

In some embodiments, the nanostructures include a ceramic. In some embodiments, the ceramic is a transition metal-containing ceramic. In some embodiments, the transition metal-containing ceramic is selected from transition metal carbides, transition metal silicides, transition metal borides, and transition metal nitrides.

In some embodiments, the nanostructures include a transition metal in elemental form. In some embodiments, the transition metal is W.

In some embodiments, the volume fraction of the nanostructures in the nanocomposite is about 5% or greater.

In some embodiments, the volume fraction of the nanostructures in the nanocomposite is about 10% or greater.

In some embodiments, the matrix includes Al, and the nanostructures include a transition metal carbide or a transition metal boride.

In some embodiments, the matrix includes Fe, and the nanostructures include a transition metal carbide, a transition metal boride, or a post-transition metal oxide.

In some embodiments, the matrix includes Ag, and the nanostructures include a transition metal in elemental form.

In some embodiments, the matrix includes Cu, and the nanostructures include a transition metal in elemental form or a transition metal carbide.

In some embodiments, the matrix includes Zn, and the nanostructures include a transition metal in elemental form or a transition metal carbide.

In some embodiments, the matrix includes Ti, and the nanostructures include a transition metal in elemental form or a transition metal silicide.

In another aspect according to some embodiments, a metal matrix nanocomposite includes: 1) a matrix including Al; and 2) nanostructures dispersed in the matrix at a volume fraction of greater than about 3% of the nanocomposite, wherein the nanostructures include a transition metal carbide or a transition metal boride.

In another aspect according to some embodiments, a metal matrix nanocomposite includes: 1) a matrix including Al; and 2) nanostructures dispersed in the matrix at a volume fraction of greater than about 3% of the nanocomposite, wherein the nanostructures include a nanostructure material, wherein a contact angle θ of a melt of Al with a respect to a surface of the nanostructure material is less than about 90°, and wherein: $|[(A_{nanostructure})^{1/2}-(A_{aluminum})^{1/2}]^2\times(1/12)\times(R/d_1)|<15.6$ zJ, and $A_{nanostructure}$ is the Hamaker constant of the nanostructure material, $A_{aluminum}$ is the Hamaker constant of Al, R is an average effective radius of the nanostructures, $d_1$ is about 0.4 nm, and k is Boltzmann's constant.

In another aspect according to some embodiments, a metal matrix nanocomposite includes: 1) a matrix including Fe; and 2) nanostructures dispersed in the matrix at a volume fraction of greater than about 3% of the nanocomposite, wherein the nanostructures include a transition metal carbide, a transition metal boride, or a post-transition metal oxide.

In another aspect according to some embodiments, a metal matrix nanocomposite includes: 1) a matrix including Fe; and 2) nanostructures dispersed in the matrix at a volume fraction of greater than about 3% of the nanocomposite, wherein the nanostructures include a nanostructure material, wherein a contact angle θ of a melt of Fe with a respect to a surface of the nanostructure material is less than about 90°, and wherein: $|[(A_{nanostructure})^{1/2}-(A_{iron})^{1/2}]^2\times(1/12)\times(R/d_1)|<27.8$ zJ, and $A_{nanostructure}$ is the Hamaker constant of the nanostructure material, $A_{iron}$ the Hamaker constant of Fe, R is an average effective radius of the nanostructures, $d_1$ is about 0.4 nm, and k is Boltzmann's constant.

In another aspect according to some embodiments, a metal matrix nanocomposite includes: 1) a matrix including Ag; and 2) nanostructures dispersed in the matrix at a volume fraction of greater than about 3% of the nanocomposite, wherein the nanostructures include a transition metal in elemental form.

In another aspect according to some embodiments, a metal matrix nanocomposite includes: 1) a matrix including Ag; and 2) nanostructures dispersed in the matrix at a volume fraction of greater than about 3% of the nanocomposite, wherein the nanostructures include a nanostructure material, wherein a contact angle θ of a melt of Ag with a respect to a surface of the nanostructure material is less than about 90°, and wherein: $|[(A_{nanostructure})^{1/2}-(A_{silver})^{1/2}]^2\times(1/12)\times(R/d_1)|<19.8$ zJ, and $A_{nanostructure}$ is the Hamaker constant of the nanostructure material, $A_{silver}$ is the Hamaker constant of Ag, R is an average effective radius of the nanostructures, $d_1$ is about 0.4 nm, and k is Boltzmann's constant.

In another aspect according to some embodiments, a metal matrix nanocomposite includes: 1) a matrix including Cu; and 2) nanostructures dispersed in the matrix at a volume fraction of greater than about 3% of the nanocomposite, wherein the nanostructures include a transition metal in elemental form or a transition metal carbide.

In another aspect according to some embodiments, a metal matrix nanocomposite includes: 1) a matrix including Cu; and 2) nanostructures dispersed in the matrix at a volume fraction of greater than about 3% of the nanocomposite, wherein the nanostructures include a nanostructure material, wherein a contact angle θ of a melt of Cu with a respect to a surface of the nanostructure material is less than about 90°, and wherein: $|[(A_{nanostructure})^{1/2}-(A_{copper})^{1/2}]^2\times(1/12)\times(R/d_1)|<21.5$ zJ, and $A_{nanostructure}$ is the Hamaker constant of the nanostructure material, $A_{copper}$ is the Hamaker constant of Cu, R is an average effective radius of the nanostructures, $d_1$ is about 0.4 nm, and k is Boltzmann's constant.

In another aspect according to some embodiments, a metal matrix nanocomposite includes: 1) a matrix including Zn; and 2) nanostructures dispersed in the matrix at a volume fraction of greater than about 3% of the nanocomposite, wherein the nanostructures include a transition metal in elemental form or a transition metal carbide.

In another aspect according to some embodiments, a metal matrix nanocomposite includes: 1) a matrix including Zn; and 2) nanostructures dispersed in the matrix at a volume fraction of greater than about 3% of the nanocomposite, wherein the nanostructures include a nanostructure material, wherein a contact angle θ of a melt of Zn with a respect to a surface of the nanostructure material is less than about 90°, and wherein: $|[(A_{nanostructure})^{1/2}-(A_{zinc})^{1/2}]^2\times(1/12)\times(R/d_1)|<12.3$ zJ, and $A_{nanostructure}$ is the Hamaker constant of the nanostructure material, $A_{zinc}$ is the Hamaker constant of Zn, R is an average effective radius of the nanostructures, $d_1$ is about 0.4 nm, and k is Boltzmann's constant.

In another aspect according to some embodiments, a metal matrix nanocomposite includes: 1) a matrix including Ti; and 2) nanostructures dispersed in the matrix at a volume fraction of greater than about 3% of the nanocomposite, wherein the nanostructures include a transition metal in elemental form or a transition metal silicide.

In another aspect according to some embodiments, a metal matrix nanocomposite includes: 1) a matrix including Ti; and 2) nanostructures dispersed in the matrix at a volume fraction of greater than about 3% of the nanocomposite, wherein the nanostructures include a nanostructure material, wherein a contact angle θ of a melt of Ti with a respect to a surface of the nanostructure material is less than about 90°, and wherein: $|[(A_{nanostructure})^{1/2}-(A_{titanium})^{1/2}]^2\times(1/12)\times(R/d_1)|<29.5$ zJ, and $A_{nanostructure}$ is the Hamaker constant of the nanostructure material, $A_{titanium}$ is the Hamaker constant of Ti, R is an average effective radius of the nanostructures, $d_1$ is about 0.4 nm, and k is Boltzmann's constant.

In a further aspect according to some embodiments, a manufacturing method includes: 1) heating one or more metals (or one or more metal elements) to form a melt; 2) introducing nanostructures into the melt at a volume fraction, including those greater than about 3%; and 3) cooling the melt to form a metal matrix nanocomposite including the nanostructures dispersed therein.

In some embodiments, the one or more metals are selected from, for example, Al, Mg, Fe, Ag, Cu, Mn, Ni, Ti, Cr, Co, and Zn.

In some embodiments, the nanostructures have an average dimension in a range of about 1 nm to about 100 nm. In some embodiments, the nanostructures have an average dimension greater than about 100 nm.

In some embodiments, the nanostructures include a ceramic, a transition metal in elemental form, or a transition metal in alloy form.

In some embodiments, the nanostructures are introduced into the melt at the volume fraction of about 5% or greater.

In some embodiments, the nanostructures are introduced into the melt at the volume fraction of about 10% or greater.

Other aspects and embodiments of this disclosure are also contemplated. The foregoing summary and the following detailed description are not meant to restrict this disclosure to any particular embodiment but are merely meant to describe some embodiments of this disclosure.

BRIEF DESCRIPTION OF THE DRAWINGS

For a better understanding of the nature and objects of some embodiments of this disclosure, reference should be made to the following detailed description taken in conjunction with the accompanying drawings.

DETAILED DESCRIPTION

Introduction

Figure 1:
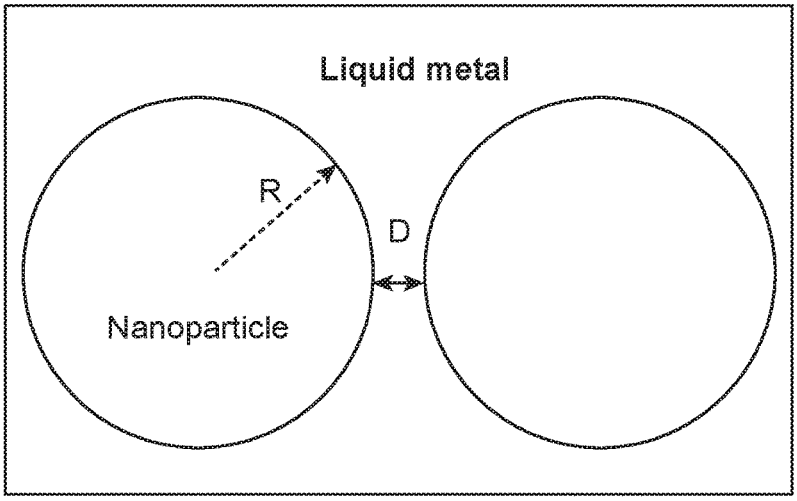
FIG. 1. Model for two nanoparticles interacting in a liquid metal.

Nanocomposites can provide desirable properties, such as mechanical, electrical, thermal, and chemical properties, for various applications. Metal matrix nanocomposites include a matrix of one or more metals and reinforcement in the form of nanostructures, such as nanoparticles, nanoplatelets, and nanofibers.

Solidification processing, a melt-based processing of metals (e.g., casting), is a promising and versatile mass manufacturing method for the production of metal matrix nanocomposites. Nanostructures are incorporated into liquid metals or semi-solid metals and dispersed by various methods, including molten salt-assisted self-incorporation, mechanical stirring, or ultrasonic processing. Liquid metals mixed with nanostructures are then cast into molds to obtain bulk metal matrix nanocomposites. Solidification processing offers the potential for economical production of bulk metal components with complex shapes. However, the incorporation of nanostructures at sufficient loading levels while mitigating against agglomeration of nanostructures in liquid metals can pose significant challenges.

A uniform nanostructure dispersion inside nanocomposites is desirable to achieve enhanced properties. The final distribution of nanostructures inside metal matrix nanocomposites can depend on the incorporation of nanostructures, the dispersion and stabilization of nanostructures in a molten metal, and the pushing of nanostructures during solidification. Despite efforts in this regard, it has remained a challenge to achieve a uniform, stabilized dispersion of nanostructures in molten metal for industrial production. Poor wettability between ceramic nanostructures and molten metal can result in nanostructure repulsion out of molten metal. Possible contamination and air bubbles attached on nanostructure surfaces can aggravate this tendency. Nanostructures also can readily aggregate to form agglomerates or clusters in molten metal, making it difficult to obtain a stable and uniform dispersion of nanostructures inside the molten metal. Ultrasonic cavitation processing can be used to obtain kinetic dispersions of nanostructures in molten metals. However, once the ultrasonic processing stops, an initial uniform dispersion of nanostructures is not stable, and interactions among nanostructures inside molten metals can redistribute the nanostructures to form agglomerates. For example, nanoparticles, initially well dispersed in molten metals during ultrasonic processing, may re-agglomerate to form clusters, which may be pushed to grain boundaries and phase boundaries during solidification. Without effective repulsive forces between nanoparticles, nanoparticles can readily form clusters due to attractive van der Waals forces in molten metals, leading to cluster formation.

Moreover, other strategies for stabilization of nanostructures are generally not effective in molten metals. For example, in molten metals, such as lightweight aluminum (Al) and magnesium (Mg), a processing temperature can be about 1000 K. Chain organic molecules responsible for steric forces are not stable at such high temperature. Moreover, molten metals can be highly conductive, resulting in the failure of repulsive forces based on electrostatic interactions.

Nanostructure Dispersion in Molten Metals:

Interactions Between Nanostructures in Molten Metals

In an example model nanoparticle-melt system as shown in FIG. 1, nanoparticles are assumed to be homogeneously distributed and dispersed in a static metal melt. The nanoparticle-melt system can be considered as a melt with a dilute dispersion of nanoparticles when the nanoparticle loading is low. In the model, just the interactions between two same type of nanoparticles in a liquid metal are considered. Additional assumptions to build the model are listed below:

Nanoparticles with a radius R are substantially spherical, and D is a gap or distance between two nanoparticles;

Negligible macroscopic convection in the melt;

Negligible electrostatic interaction or double layers between nanoparticles and metal melt;

Negligible buoyance and gravity forces for nanoparticles;

Negligible chemical reaction between nanoparticles and metal melt; and

No gas film or contamination on surfaces of nanoparticles.

Based on the above assumptions, three interactions, interfacial energy, van der Waals potential, and Brownian potential, are considered in this model nanoparticle-melt system.

Interfacial Energy

When two nanoparticles interact in a liquid metal far from each other, the interfacial energy can be described as $$G_b=2S_{pl}\sigma_{pl}$$

where $S_{pl}$ is the surface area of a nanoparticle and $\sigma_{pl}$ is the interfacial energy between the nanoparticle and liquid metal. If the two nanoparticles move close to squeeze metal atoms out to create a void between them, the interfacial energy becomes $$G_b=2(S_{pl}-S_{pp})\sigma_{pl}+2S_{pp}\sigma_p$$

where $S_{pp}$ and $\sigma_p$ is the effective contact area and the surface energy of the nanoparticle. If the two nanoparticles reach an adhesive contact to chemically bond together (sintering starts), there will be no physical interface between the two nanoparticles. This global energy minimum can be set to be 0 (or another baseline value).

Therefore, when two nanoparticles move close enough to squeeze metal atoms out to create a void between them, the change in Gibbs free energy can be described as $$\Delta G_1 = 2S(\sigma_p - \sigma_{pl})$$

where S is the effective contact area. If the nanoparticles move further close to start fusion together, the further change in Gibbs free energy can be described as $$\Delta G_2 = -2S\sigma_p$$

Figure 2:
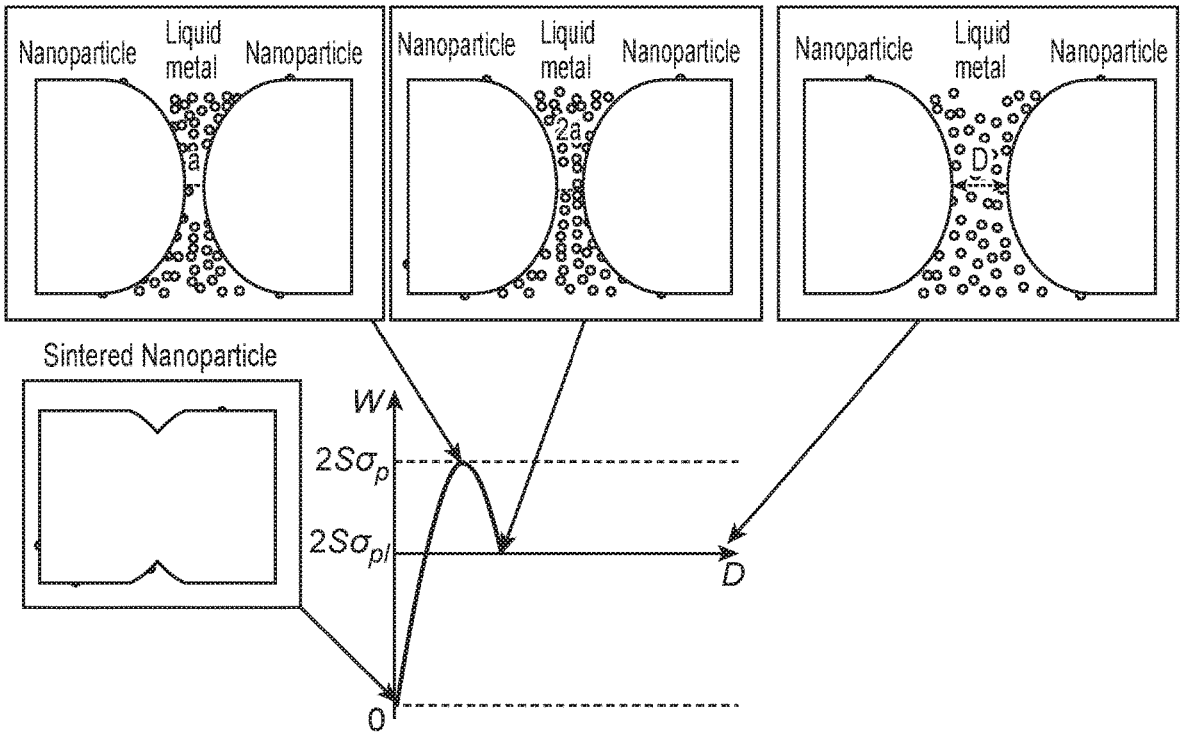
FIG. 2. Interfacial energy W changes along distance D between two nanoparticles. S: effective surface area; $\sigma_{pl}$: interfacial energy between nanoparticles and liquid metal; $\tau_p$: surface energy of nanoparticles; a: characteristic atomic diameter of liquid metal.

Since the interfacial energy $\sigma_p$ is positive (always positive), $\Delta G_2$ is negative (always negative). The schematic of the interfacial energies for two nanoparticles in a liquid metal is shown in FIG. 2.

$\sigma_p$ and $\sigma_{pl}$ are influenced by chemical bonds, mainly covalent bond, metallic bond, or both, formed between the metal and a nanoparticle surface, which has a short characteristic length up to about 0.2-0.4 nm. Under a thermodynamic favorable condition, when the distance between the two nanoparticles is less than the typical characteristic length of chemical bonds, adhesion would be initiated. Beyond this distance, the contribution to the interfacial energy by the chemical bonds can be considered to be negligible. A general expression for the interaction potential of two similar surfaces of a unit area along with the gap between them, D, may be applied as below:

$$W_{inter}(D) = 2S(\sigma_p - \sigma_{pl})e^{-(D-D_0)/a_0}\frac{D-a_0}{D_0-a_0} \text{ for } D_0 < D < a_0$$

$$W_{inter}(D) = -2S\sigma_p e^{D/a_0}(1 - D/D_0) + 2S(\sigma_p + \sigma_{pl})$$

$$\text{for } 0 < D < D_0$$

where $D_0$ is the length of a chemical bond, and $a_0$ is the characteristic decaying length (typically about 0.2-0.4 nm) for the chemical bond, namely about two times of $D_0$ in this case.

The interaction potential at $d_2 \approx D_0$ (or $\Delta G_1$ at $d_2 \approx D_0$) can represent an energy barrier $W_{barrier}$ due to the interfacial energy, and can be expressed as $2S(\sigma_p - \sigma_{pl})$ which is proportional to $S\sigma_l \cos\theta$, where $\sigma_l$ is the surface tension of the metal melt, and $\theta$ is the contact angle of the metal melt on the nanoparticle material surface. The better the wetting between nanoparticles and molten metal (smaller $\theta$), the higher the energy barrier that prevents the nanoparticles from contacting each other. Contact angles can be derived through techniques such as sessile drop test, and measurements can be conducted in vacuum or an inert gas atmosphere, such as helium or argon. Table 1 shows example values of contact angles for some representative metals on ceramics in vacuum or an inert gas.

TABLE 1

Contact angles of some metals on ceramics.

| Ceramic | Metal | Contact Angle | Temp. ° C. |
|---|---|---|---|
| $TiB_2$ | Ag | 126 | 1100 |
| $TiB_2$ | Ag | 91 | 1600 |
| $TiB_2$ | Ni | 38.5 | 1480 |
| $TiB_2$ | Ni | 0 | 1500 |
| $TiB_2$ | Cu | 135-132 | 1100-1300 |
| $TiB_2$ | Al | 140-38 | 900-1250 |
| $TiB_2$ | Fe | 62 | 1550 |
| $TiB_2$ | Co | 20 | 1500-1600 |
| $ZrB_2$ | Fe | 55 | 1550 |
| $ZrB_2$ | Co | 39 | 1500 |

TABLE 1-continued

Contact angles of some metals on ceramics.

| Ceramic | Metal | Contact Angle | Temp. ° C. |
|---|---|---|---|
| $ZrB_2$ | Ni | 42 | 1500 |
| $ZrB_2$ | Ag | 114 | 1100 |
| $ZrB_2$ | Ag | 70 | 1600 |
| $ZrB_2$ | Al | 106-60 | 900-1250 |
| $HfB_2$ | Al | 134-60 | 900-1250 |
| $HfB_2$ | Fe | 100 | 1550 |
| $HfB_2$ | Ni | 99 | 1480-1600 |
| $VB_2$ | Fe | 17 | 1550 |
| $VB_2$ | Ni | 0 | 1450 |
| $VB_2$ | Co | 0 | 1500 |
| $W_2B_5$ | Fe | 0 | 1550 |
| $W_2B_5$ | Ni | 4 | 1450 |
| $W_2B_5$ | Co | 19 | 1500 |

Van Der Waals Potential

Van der Waals potential between two nanoparticles in a liquid metal is of a relatively long range. The attractive force induced by the van der Waals potential drives nanoparticles together. The van der Waals potential for two spheres of radius $R_1$ and $R_2$ is determined by:

$$W_{vdw}(D) = -\frac{A}{6D}\left(\frac{R_1 R_2}{R_1 + R_2}\right)$$

and the force is determined by:

$$F_{vdw}(D) = -\frac{A}{6D^2}\left(\frac{R_1 R_2}{R_1 + R_2}\right)$$

where A is the system Hamaker constant for the nanoparticle interactions in the liquid metal. Based on the Lifshitz theory, in a three-component system, the non-retarded Hamaker constant between media 1 and 2 across media 3 can be estimated by:

$$A = \frac{3}{4}kT\left(\frac{\varepsilon_1 - \varepsilon_3}{\varepsilon_1 + \varepsilon_3}\right)\left(\frac{\varepsilon_2 - \varepsilon_3}{\varepsilon_2 + \varepsilon_3}\right) + \frac{3h}{4\pi}\int_{v_1}^{\infty}\left[\frac{\varepsilon_1(iv_n) - \varepsilon_3(iv_n)}{\varepsilon_1(iv_n) + \varepsilon_3(iv_n)}\right]\left[\frac{\varepsilon_2(iv_n) - \varepsilon_3(iv_n)}{\varepsilon_2(iv_n) + \varepsilon_3(iv_n)}\right]dv$$

where $\varepsilon_1$, $\varepsilon_2$ and $\varepsilon_3$ are the static dielectric constants of the three media, $\varepsilon(iv)$ is the value of $\varepsilon$ at imaginary frequencies, and $$v_n = \left(\frac{2\pi kT}{h}\right)n.$$

At room temperature and above, frequencies are in the ultra-violet (UV) region.

The system Hamaker constant $A_{132}$, specified for material 1 and 2 interacting through medium 3, can be approximately related to $A_{11}$ and $A_{22}$ through $$A_{132} \approx (\sqrt{A_{11}} - \sqrt{A_{33}})(\sqrt{A_{22}} - \sqrt{A_{33}})$$

where $A_{11}$, $A_{22}$ and $A_{33}$ are material 1, 2 and 3 interaction with themselves through vacuum.

In a nanoparticle-metal system, the system Hamaker constant can be described as $$A_{sys} \approx (\sqrt{A_{\text{nanoparticle1}}} - \sqrt{A_{\text{liquid}}})(\sqrt{A_{\text{nanoparticle2}}} - \sqrt{A_{\text{liquid}}})$$

And hence the van der Waals potential can be written as $$W_{vdw}(D) = -\frac{(\sqrt{A_{nanoparticle1}} - \sqrt{A_{liquid}})(\sqrt{A_{nanoparticle2}} - \sqrt{A_{liquid}})}{6D}\left(\frac{R_1 R_2}{R_1 + R_2}\right)$$

Therefore, the van der Waals potential between two similar nanoparticles is negative (always negative), and the van der Waals force between two same nanoparticles in the liquid metal is attractive (always attractive). The van der Waals potential at $d_1 \approx a_0$ can represent an energy well $W_{vdwmax}$, and can be expressed as $$W_{vdwmax} = -\frac{(\sqrt{A_{nanop}} - \sqrt{A_{liquid}})^2}{6d_1}\left(\frac{R_1 R_2}{R_1 + R_2}\right)$$

Hamaker constants can be derived through techniques such as atomic force microscopy measurements in vacuum, measurements of transmission electromagnetic spectrum, and measurements of electron energy-loss spectrum to extract plasma frequencies. For example, Hamaker constants can be derived through integration of dielectric constants over frequency as set forth in Lee, "Calculation of Hamaker Coefficients for Metallic Aerosols from Extensive Optical Data," Particles on Surfaces 1, pp. 77-90, 1988. Table 2 shows example values of Hamaker constants for some representative metals and ceramics in vacuum.

TABLE 2

Hamaker constant of some metals and ceramics.

| Materials | Hamaker constant (zeptoJoule (zJ)) |
|---|---|
| Aluminum (Al) melt | 266 (liquid), 360 (solid) |
| Magnesium (Mg) melt | 206 |
| Aluminum oxide ($Al_2O_3$) | 140 |
| Silicon carbide (SiC) | 248 |
| Titanium boride ($TiB_2$) | 256 |
| Magnesium oxide (MgO) | 120 |
| Titanium oxide ($TiO_2$) | 150 |
| Titanium carbide (TiC) | 238 |
| Silicon oxide ($SiO_2$) | 71.6 |
| Iron (Fe) | 260 |
| Silver (Ag) | 440 |
| Gold (Au) | 480 |
| Copper (Cu) | 460 |
| Manganese (Mn) | 150 |
| Nickel (Ni) | 320 |
| Tungsten (W) | 400 |
| Silicon (Si) | 260 |
| Titanium (Ti) | 380 |
| Chromium (Cr) | 526 |
| Cobalt (Co) | 441 |
| Zinc (Zn) | 362 |
| Zirconium oxide ($ZrO_2$) | 200 |

Brownian Potential

Since nanoparticles are small and move randomly under thermal fluctuations, Brownian potential should be considered. In the model, a displacement along the direction that two nanoparticles approach each other is considered. Equipartition theorem indicates that the kinetic energy/potential of the Brownian motion is kT/2 in one dimension for one nanoparticle. Thus the Brownian motion energy for the two nanoparticles system in one dimension is kT. For two nanoparticles in the liquid metal at elevated temperatures, kT may be comparable to the van der Waals potential, and thus Brownian potential can play an important role on nanoparticle dispersion.

Three Cases for Nanoparticle Dispersion in Molten Metals

In the model system for nanoparticle dispersion in a liquid metal, the van der Waals potential, interfacial energy, and Brownian potential co-exist. The interfacial energy can become dominant when a gap between two nanoparticles reaches one or two atomic layers. The van der Waals interaction can become dominant outside this gap until a longer distance (e.g., from about 0.4 nm and up to about 10 nm or more). Three possible cases for nanoparticle dispersion can be deduced from the model analysis: clusters, pseudo-dispersion, and self-dispersion.

Figure 3:
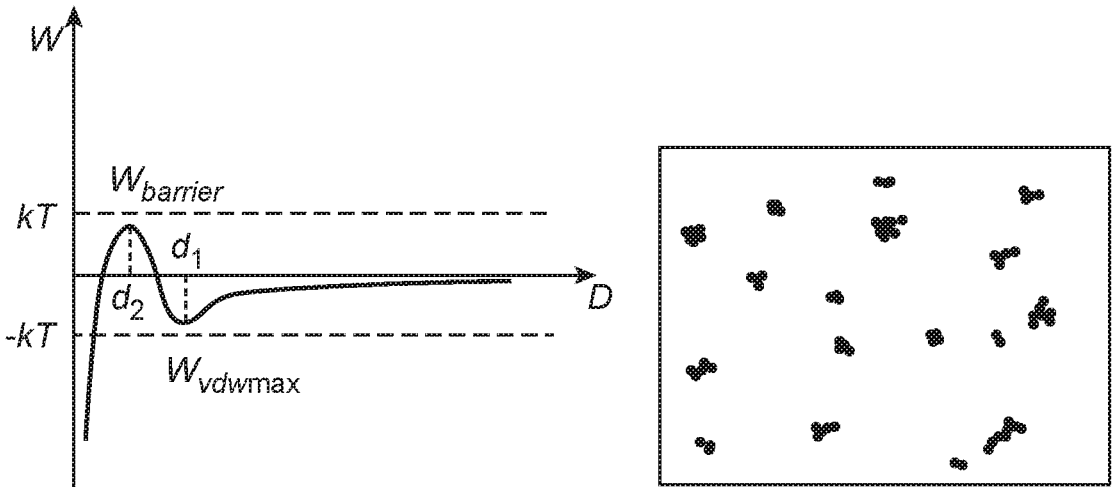
FIG. 3. Interaction potential for nanoparticles to form clusters.

Clusters: FIG. 3 shows the interaction potentials for nanoparticles to form clusters. $W_{barrier}$ and $W_{vdwmax}$ are $\Delta G_1$ at the chemical bond characteristic length and the maximum van der Waals potential in the energy well, respectively. If $W_{barrier}$ is small (less than about 10 kT, for example, due to a poor wettability between the nanoparticle and the liquid metal) and the van der Waals potential well is not deep enough, the Brownian potential kT can drive the nanoparticles to the adhesive contact to form chemical bonds, thereby fusing together. Nanoparticle clusters thus will form in the liquid metal when the following conditions apply: (1) $W_{vdwmax} > -kT$ (or $|W_{vdwmax}| < kT$); and (2) $W_{barrier} < kT$.

Figure 4:
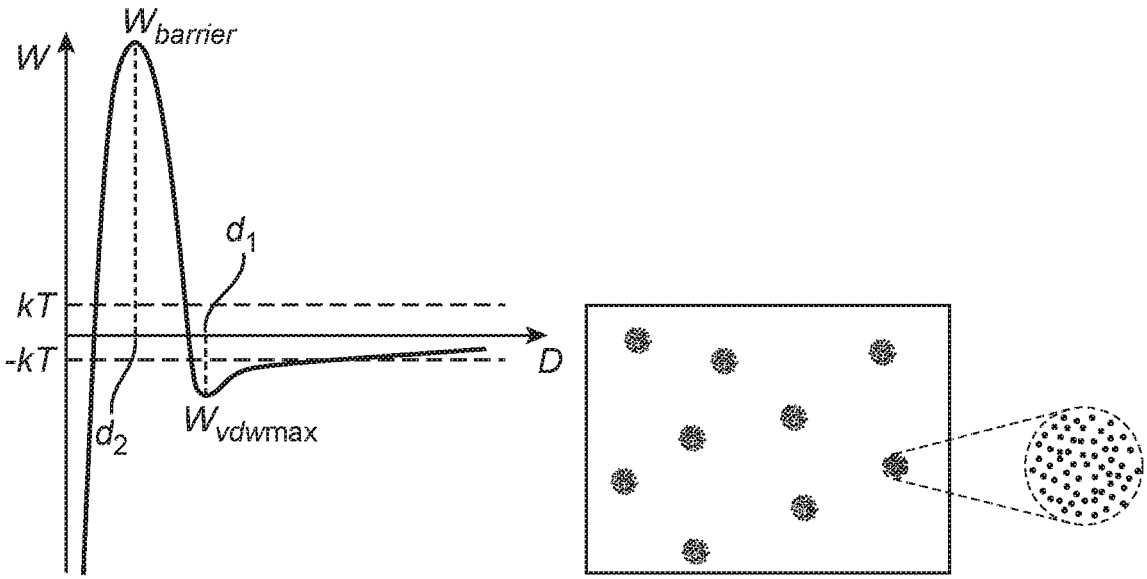
FIG. 4. Interaction potential for nanoparticle pseudo-dispersion.

Pseudo-dispersion: FIG. 4 shows the interaction potentials for nanoparticle pseudo-dispersion in the liquid metal. If $W_{barrier}$ is high (greater than about 10 kT, for example, due to good wettability between the nanoparticle and the liquid metal), the Brownian potential kT cannot drive the nanoparticles to pass the barrier for adhesive contact. But if the van der Waals potential well is deep, the nanoparticles may be kinetically trapped in the well, forming a cluster of separate nanoparticles in a pseudo-dispersion. Nanoparticles thus will form pseudo-dispersion domains where dense nanoparticles are separated by a few layers of metal atoms. Thus, nanoparticle pseudo-dispersion will form in the liquid metal when the following conditions apply: (1) $W_{vdwmax} < -kT$ (or $|W_{vdwmax}| > kT$); and (2) $W_{barrier} > 10$ kT.

Figure 5:
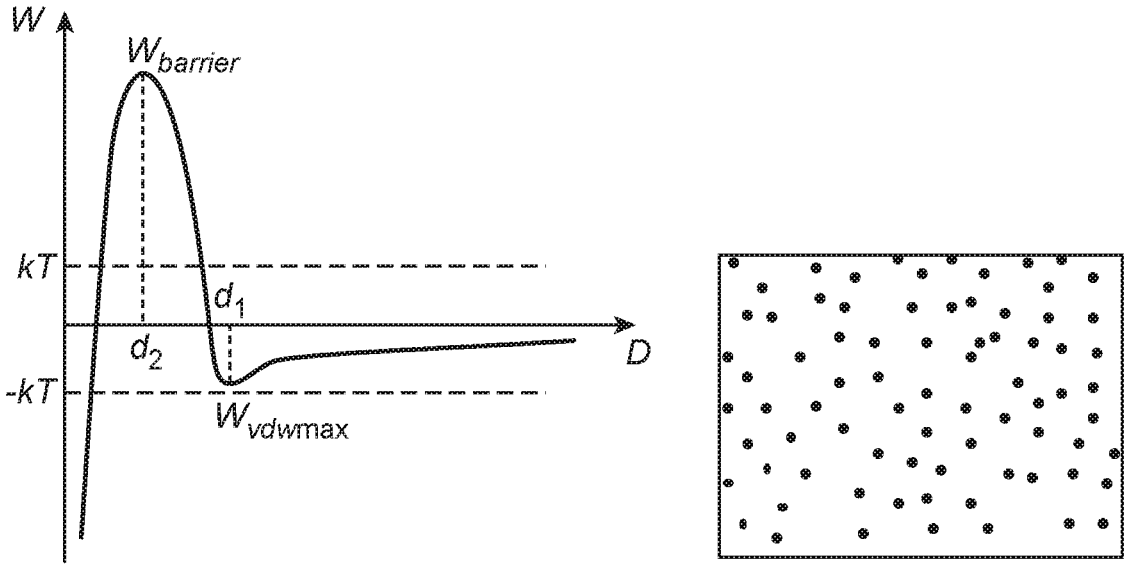
FIG. 5. Interaction potential for nanoparticle self-dispersion.

Self-dispersion: FIG. 5 shows the interaction potentials for nanoparticle self-dispersion in the liquid metal. If $W_{barrier}$ is high (greater than about 10 kT, for example, due to good wettability between the nanoparticle and the liquid metal) and the van der Waals potential well is not deep, the Brownian potential kT cannot drive the nanoparticles to pass the barrier for adhesive contact, and the nanoparticles are not kinetically trapped in the well. This would allow nanoparticles to move without forming clusters or pseudo-dispersion domains in the liquid metal, thus attaining self-dispersion. Thus, nanoparticle self-dispersion will form in the liquid metal when the following conditions apply: (1) $W_{vdwmax} > -kT$ (or $|W_{vdwmax}| < kT$); and (2) $W_{barrier} > 10$ kT. The elucidation of a self-dispersion mechanism through the model can serve as a powerful tool to realize a uniform dispersion of nanoparticles in large scale solidification processing of bulk nanocomposites.

Metal Matrix Nanocomposites:

Some embodiments of this disclosure are directed to metal matrix nanocomposites including a high volume fraction of uniformly dispersed nanostructures and methods of manufacturing of such nanocomposites. The metal matrix nanocomposites including uniformly dispersed, high volume fraction of nanostructures can be used as high performance structural materials or as master alloys for fabrication of such structural materials.

In some embodiments, a metal matrix nanocomposite includes a matrix of one or more metals and reinforcing nanostructures dispersed in the matrix. Examples of suitable matrix materials include aluminum (Al), magnesium (Mg), iron (Fe), silver (Ag), copper (Cu), manganese (Mn), nickel (Ni), titanium (Ti), chromium (Cr), cobalt (Co), zinc (Zn), alloys, mixtures, or other combinations of two or more of the foregoing metals, such as Ti—Al alloys, Al—Mg alloys, and Mg—Zn alloys, and alloys, mixtures, or other combinations of one or more of the foregoing metals with other elements, such as steel (e.g., iron-carbon alloys or iron-chromium-carbon alloys).

In some embodiments, the nanostructures can have at least one dimension in a range of about 1 nm to about 1000 nm, such as about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm. In some embodiments, the nanostructures can have at least one average or median dimension in a range of about 1 nm to about 1000 nm, such as about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm. In some embodiments, the nanostructures can include nanoparticles having an aspect ratio of about 5 or less or about 3 or less or about 2 or less and having generally spherical or spheroidal shapes, although other shapes and configurations of nanostructures are contemplated, such as nanofibers and nanoplatelets. In the case of nanoparticles of some embodiments, the nanoparticles can have at least one dimension (e.g., an effective diameter which is twice an effective radius) or at least one average or median dimension (e.g., an average effective diameter which is twice an average effective radius) in a range of about 1 nm to about 1000 nm, such as about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

In some embodiments, the nanostructures can include one or more ceramics, although other nanostructure materials are contemplated, including metals or other conductive materials. Examples of suitable nanostructure materials include metal oxides (e.g., alkaline earth metal oxides, post-transition metal oxides, and transition metal oxides, such as aluminum oxide ($Al_2O_3$), magnesium oxide (MgO), titanium oxide ($TiO_2$), and zirconium oxide ($ZrO_2$)), non-metal oxides (e.g., silicon oxide ($SiO_2$)), metal carbides (e.g., transition metal carbides, such as titanium carbide (TiC), niobium carbide (NbC), chromium carbide ($Cr_3C_2$), nickel carbide (NiC), hafnium carbide (HfC), vanadium carbide (VC), tungsten carbide (WC), and zirconium carbide (ZrC)), non-metal carbides (e.g., silicon carbide (SiC)), metal silicides (e.g., transition metal silicides, such as titanium silicide ($Ti_5Si_3$)), metal borides (e.g., transition metal borides, such as titanium boride ($TiB_2$), zirconium boride ($ZrB_2$), hafnium boride ($HfB_2$), vanadium boride ($VB_2$), and tungsten boride ($W_2B_5$)), metal nitrides (e.g., transition metal nitrides), metals (e.g., transition metals in elemental form such as tungsten (W)), alloys, mixtures, or other combinations of two or more of the foregoing, and alloys, mixtures, or other combinations of one or more of the foregoing with other elements. Particular examples of suitable nanostructure materials include transition metal-containing ceramics, where the presence of a transition metal can impart a greater Hamaker constant more closely approaching that of a metal matrix for a reduced van der Waals potential well, such as transition metal carbides, transition metal silicides, transition metal borides, transition metal nitrides, and other non-oxide, transition metal-containing ceramics.

Suitable nanostructures can be selected for self-dispersion in a metal matrix for solidification processing at a temperature T, which can be set to about ($T_{melt}$+200 K), with $T_{melt}$ being a melting temperature of a matrix material, although other processing temperatures in a range greater than about $T_{melt}$ and up to about ($T_{melt}$+250 K) are contemplated. In some embodiments, selection of the nanostructures can satisfy the following conditions: (1) the nanostructures undergo little or no chemical reaction with a melt of the matrix; (2) good wettability of the nanostructures by the melt of the matrix, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{matrix})^{1/2}]^2\times(1/12)\times(R/d_1)|<kT \quad (3)$$

where $A_{nanostructure}$ is the Hamaker constant of the nanostructure material, $A_{matrix}$ is the Hamaker constant of the matrix material, R is an average effective radius of the nanostructures, $d_1$ can be set to be about 0.4 nm, and k is Boltzmann's constant.

For example, in the case of a matrix of aluminum having a melting temperature of about 933 K (or an aluminum-containing alloy with aluminum as a majority component), selection of the nanostructures can satisfy the following conditions at a processing temperature T of about 1133 K: (1) the nanostructures undergo little or no chemical reaction with a melt of aluminum; (2) good wettability of the nanostructures by the melt of aluminum, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{aluminum})^{1/2}]^2\times(1/12)\times(R/d_1)|<15.6 \text{ zJ} \quad (3)$$

where $A_{nanostructure}$ is the Hamaker constant of the nanostructure material, $A_{aluminum}$ is the Hamaker constant of aluminum, R is an average effective radius of the nanostructures, $d_1$ can be set to be about 0.4 nm, and k is Boltzmann's constant. Examples of suitable nanostructure materials for dispersion in aluminum include transition metal carbides (e.g., TiC) and transition metal borides (e.g., $TiB_2$), among other transition metal-containing ceramics, and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

For example, in the case of a matrix of magnesium having a melting temperature of about 923 K (or a magnesium-containing alloy with magnesium as a majority component), selection of the nanostructures can satisfy the following conditions at a processing temperature T of about 1123 K: (1) the nanostructures undergo little or no chemical reaction with a melt of magnesium; (2) good wettability of the nanostructures by the melt of magnesium, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{magnesium})^{1/2}]^2\times(1/12)\times(R/d_1)|<15.5 \text{ zJ} \quad (3)$$

where $A_{nanostructure}$ is the Hamaker constant of the nanostructure material, $A_{magnesium}$ is the Hamaker constant of magnesium, R is an average effective radius of the nanostructures, $d_1$ can be set to be about 0.4 nm, and k is Boltzmann's constant. Examples of suitable nanostructure materials for dispersion in magnesium include non-metal carbides (e.g., SiC), among other ceramics, and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

For example, in the case of a matrix of iron having a melting temperature of about 1811 K (or an iron-containing alloy with iron as a majority component), selection of the nanostructures can satisfy the following conditions at a processing temperature T of about 2011 K: (1) the nanostructures undergo little or no chemical reaction with a melt of iron; (2) good wettability of the nanostructures by the melt of iron, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{iron})^{1/2}]^2\times(1/12)\times(R/d_1)|<27.8 \text{ zJ} \quad (3)$$

where $A_{nanostructure}$ is the Hamaker constant of the nanostructure material, $A_{on}$ is the Hamaker constant of iron, R is an average effective radius of the nanostructures, $d_1$ can be set to be about 0.4 nm, and k is Boltzmann's constant. Examples of suitable nanostructure materials for dispersion in iron include transition metal carbides (e.g., NbC, NiC, and TiC), transition metal borides (e.g., $TiB_2$), and post-transition metal oxides (e.g., $Al_2O_3$), among other ceramics, and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

For example, in the case of a matrix of silver having a melting temperature of about 1235 K (or a silver-containing alloy with silver as a majority component), selection of the nanostructures can satisfy the following conditions at a processing temperature T of about 1435 K: (1) the nanostructures undergo little or no chemical reaction with a melt of silver; (2) good wettability of the nanostructures by the melt of silver, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{silver})^{1/2}]^2\times(1/12)\times(R/d_1)|<19.8 \text{ zJ} \quad (3)$$

where $A_{nanostructure}$ is the Hamaker constant of the nanostructure material, $A_{silver}$ is the Hamaker constant of silver, R is an average effective radius of the nanostructures, $d_1$ can be set to be about 0.4 nm, and k is Boltzmann's constant. Examples of suitable nanostructure materials for dispersion in silver include transition metals (e.g., W), and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

For example, in the case of a matrix of copper having a melting temperature of about 1358 K (or a copper-containing alloy with copper as a majority component), selection of the nanostructures can satisfy the following conditions at a processing temperature T of about 1558 K: (1) the nanostructures undergo little or no chemical reaction with a melt of copper; (2) good wettability of the nanostructures by the melt of copper, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{copper})^{1/2}]^2\times(1/12)\times(R/d_1)|<21.5 \text{ zJ} \quad (3)$$

where $A_{nanostructure}$ is the Hamaker constant of the nanostructure material, $A_{copper}$ is the Hamaker constant of copper, R is an average effective radius of the nanostructures, $d_1$ can be set to be about 0.4 nm, and k is Boltzmann's constant. Examples of suitable nanostructure materials for dispersion in copper include transition metals and transition metal carbides (e.g., W and WC), and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

For example, in the case of a matrix of zinc having a melting temperature of about 693 K (or a zinc-containing alloy with zinc as a majority component), selection of the nanostructures can satisfy the following conditions at a processing temperature T of about 893 K: (1) the nanostructures undergo little or no chemical reaction with a melt of zinc; (2) good wettability of the nanostructures by the melt of zinc, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{zinc})^{1/2}]^2\times(1/12)\times(R/d_1)|<12.3 \text{ zJ} \quad (3)$$

where $A_{nanostructure}$ is the Hamaker constant of the nanostructure material, $A_{zinc}$ is the Hamaker constant of zinc, R is an average effective radius of the nanostructures, $d_1$ can be set to be about 0.4 nm, and k is Boltzmann's constant. Examples of suitable nanostructure materials for dispersion in zinc include transition metals and transition metal carbides (e.g., W and WC), and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

For example, in the case of a matrix of titanium having a melting temperature of about 1941 K (or a titanium-containing alloy with titanium as a majority component), selection of the nanostructures can satisfy the following conditions at a processing temperature T of about 2141 K: (1) the nanostructures undergo little or no chemical reaction with a melt of titanium; (2) good wettability of the nanostructures by the melt of titanium, as characterized by, for example, a contact angle θ of the melt with a respect to a surface of a nanostructure material at the processing temperature T of less than about 90°, such as about 88° or less, about 85° or less, about 80° or less, about 75° or less, about 70° or less, about 60° or less, about 50° or less, about 40° or less, or about 30° or less; and $$|W_{vdwmax}|<kT \text{ or } |[(A_{nanostructure})^{1/2}-(A_{titanium})^{1/2}]^2\times(1/12)\times(R/d_1)|<29.5 \text{ zJ} \quad (3)$$

where $A_{nanostructure}$ is the Hamaker constant of the nanostructure material, $A_{titanium}$ is the Hamaker constant of titanium, R is an average effective radius of the nanostructures, $d_1$ can be set to be about 0.4 nm, and k is Boltzmann's constant. Examples of suitable nanostructure materials for dispersion in titanium include transition metals (e.g., W) and transition metal silicides (e.g., $Ti_5Si_3$), and suitable nanostructures can have an average effective diameter in a range of about 1 nm to about 100 nm, about 1 nm to about 80 nm, about 1 nm to about 60 nm, about 1 nm to about 40 nm, about 1 nm to about 20 nm, or about 1 nm to about 10 nm, although other ranges within about 1 nm to about 1000 nm are contemplated, such as about 1 nm to about 500 nm or about 1 nm to about 200 nm.

In some embodiments, a metal matrix nanocomposite can include nanostructures at a high volume fraction of, for example, greater than about 3%, such as about 5% or greater, about 6% or greater, about 7% or greater, about 8% or greater, about 9% or greater, about 10% or greater, about 11% or greater, about 12% or greater, about 13% or greater, or about 14% or greater, and up to about 20% or more.

In some embodiments, a metal matrix nanocomposite can include a uniform dispersion of nanostructures in a matrix. In some embodiments, the nanostructures can be uniformly dispersed in the matrix at a high volume fraction of, for example, greater than about 3%, such as about 5% or greater, about 6% or greater, about 7% or greater, about 8% or greater, about 9% or greater, about 10% or greater, about 11% or greater, about 12% or greater, about 13% or greater, or about 14% or greater, and up to about 20% or more. In other embodiments, the nanostructures can be uniformly dispersed in the matrix at a volume fraction of, for example, about 3% or less.

Dispersion of nanostructures in a matrix can be characterized based on image analysis of one or more images, such as one or more scanning electron microscopy (SEM) images, with nanostructures in an image corresponding to pixels having brightness or other intensity values at or above a threshold value (or at or below a threshold value in other implementations), and can be calculated relative to a sample size of nanostructures in one or more images of, for example, at least 50 nanostructures, at least 100 nanostructures, at least 200 nanostructures, or at least 500 nanostructures.

In connection with image analysis, for each nanostructure in an image, a distance (center-to-center distance) to its nearest neighbor nanostructure is determined, and a distribution of nearest neighbor distances can be derived across one or more images to obtain an average (or mean) distance and a variation (or spread) of nearest neighbor distances about the average distance. Based on such image analysis for some embodiments, at least 70% of nearest neighbor distances can lie within a band of (0.9×average distance) and (1.1×average distance), such as at least 80% or at least 90%. Further, a reference (theoretical) dispersion of an applicable volume fraction of nanostructures can be considered, where the nanostructures are regularly positioned with equal distances between nearest neighbors, and a reference (theoretical) nearest neighbor distance can be derived. For some embodiments, nanostructures can be characterized as uniformly dispersed in a matrix if an average (or mean) nearest neighbor distance derived from image analysis lies within a band of (0.7×reference (theoretical) distance) and (1.3×reference (theoretical) distance), such as within (0.8×reference (theoretical) distance) and (1.2×reference (theoretical) distance) or within (0.9×reference (theoretical) distance) and (1.1×reference (theoretical) distance).

During manufacturing by solidification processing, one or more metals can be heated in a furnace to form a melt. Next, nanostructures can be introduced into the melt at a desired volume fraction, and the nanostructures and the melt can be self-dispersed or mixed by, for example, mechanical stirring, ultrasonic processing, or other manner of agitation. Solidification of the melt by cooling yields a metal matrix nanocomposite including the nanostructures dispersed therein. In some embodiments, the nanostructures can be introduced into the melt at a high volume fraction of, for example, greater than about 3%, such as about 5% or greater, about 6% or greater, about 7% or greater, about 8% or greater, about 9% or greater, about 10% or greater, about 11% or greater, about 12% or greater, about 13% or greater, or about 14% or greater, and up to about 20% or more. In other embodiments, the nanostructures can be introduced into the melt at a low volume fraction of, for example, about 3% or less, and then evaporation of one or more metals from the melt or other processing can be applied to concentrate the volume fraction of the nanostructures to greater than about 3%, thereby attaining the metal matrix nanocomposite including a high volume fraction of the nanostructures. The resulting nanocomposite can provide desirable properties for various applications. For example, the nanocomposite can have a high yield strength of about 300 MPa or greater, such as about 350 MPa or greater, about 400 MPa or greater, about 450 MPa or greater, about 500 MPa or greater, about 550 MPa or greater, about 600 MPa or greater, or about 650 MPa or greater, and up to about 700 MPa or greater, or up to about 750 MPa or greater.

EXAMPLES

The following examples describe specific aspects of some embodiments of this disclosure to illustrate and provide a description for those of ordinary skill in the art. The examples should not be construed as limiting this disclosure, as the examples merely provide specific methodology useful in understanding and practicing some embodiments of this disclosure.

Example 1

TiC Nanoparticles Dispersion in Al Melt

Theoretical Analysis of TiC Nanoparticles Dispersion in Al Melt:

For two TiC nanoparticles in a pure Al melt at about 1093 K, the van der Waals interaction potential can be calculated by the following equation:

$$W_{vdw}(D) = -\frac{\left(\sqrt{A_{TiC}} - \sqrt{A_{Al}}\right)^2}{6D}\left(\frac{R_1 R_2}{R_1 + R_2}\right)$$

where D is the distance between the two nanoparticles (in nm scale and beyond one atomic layer); and $A_{TiC}$ and $A_{Al}$ are the Hamaker constants for TiC (about 238 zJ) and molten Al (about 266 zJ~360 zJ) respectively. $R_1$ and $R_2$ are the radii of the two nanoparticles. The van der Waals interaction between two same TiC nanoparticles in liquid Al is thus $$W_{vdw}(D) = -\frac{\left(\sqrt{A_{TiC}} - \sqrt{A_{Al}}\right)^2}{6D}\frac{R}{2}$$

The unit of D and R is nm while that of $W_{vdw}(D)$ is zJ ($10^{-21}$ J). It should be noted that the above equation is effective when two TiC nanoparticles interact through the molten Al when D is larger than about two atomic layers (e.g., about 0.4 nm).

According to the Langbein approximation, if the effective interaction area of two spheres is $$S = 2\pi\frac{R_1 R_2}{R_1 + R_2}D_0,$$

the interfacial energy barrier will be $$W_{inter}(D) = 2S(\sigma_p - \sigma_{pl})e^{-(D-D_0)/a_0}\frac{D - a_0}{D_0 - a_0}$$

for $D_0 < D < a_0$ $$W_{inter}(D) = -2S\sigma_p e^{D/a_0}(1 - D/D_0) + 2S(\sigma_p - \sigma_{pl})$$

for $0 < D < D_0$

Thermal energy at about 1093 K is kT=about 15.1 zJ.

For TiC nanoparticles with an average radius of about 25 nm used in this example, if the Hamaker constant of Al is selected to be about 266 zJ, the attraction energy well $W_1$ would be $$W_1 = W_{vdw}(d_1) = -\frac{\left(\sqrt{A_{TiC}} - \sqrt{A_{Al}}\right)^2}{6d_1}\left(\frac{R_1 R_2}{R_1 + R_2}\right) = -6.8 \text{ zJ}$$

But if the Hamaker constant of liquid Al is selected to be about 360 zJ, the attraction energy well $W_1$ would be $$W_1 = W_{vdw}(d_1) = -\frac{\left(\sqrt{A_{TiC}} - \sqrt{A_{Al}}\right)^2}{6d_1}\left(\frac{R_1 R_2}{R_1 + R_2}\right) = -131 \text{ zJ}$$

The surface energy of liquid Al is about 1.1 J/m$^2$ while about 1.35 J/m$^2$ for TiC. The wetting angle between Al and TiC is about 50° at the processing temperature of about 1093 K. The energy barrier $W_2$ due to the interfacial energy will be $$W_2 = W_{inter}(D_0) = 4\pi\frac{R_1 R_2}{R_1 + R_2}D_0(\sigma_p - \sigma_{pl})e^{-(D_0-D_0)/a_0}\frac{D_0 - a_0}{D_0 - a_0} = 26.48\times10^3 \text{ zJ} > 1600 \text{ kT}$$

Since $W_2$ is far larger than the Brownian potential, there is little chance for nanoparticles to overcome the energy barrier to reach adhesive contact. However, due to the range of the reported Hamaker constant for liquid Al, it is not conclusively predicted if the TiC nanoparticles would be in pseudo- or self-dispersion in the liquid Al.

Salt-Assisted Nanoparticle Incorporation:

Issues may be encountered for a direct feeding of TiC nanoparticles into Al melt as TiC nanoparticles can float on a surface or settle down to a bottom of the Al melt, due to a partial burning of TiC nanoparticles and natural oxide films on Al melt at high temperature. K—Al—F based salt can be used to improve the wettability of Al on TiC at temperatures up to about 1173 K. Thus, a salt-assisted nanoparticles incorporation method was developed to obtain master Al nanocomposites with a high loading of TiC nanoparticles.

$KAlF_4$ salt pellets and TiC nanoparticles (with an average radius of about 25 nm) were mixed together in acetone (about 10 vol. % nanoparticles in the salt) by ultrasonic processing for about 2 hrs. After the mixing, acetone was evaporated away at room temperature in a fume hood, resulting well-mixed salt-TiC nanocomposite powders. The mixed powders were then dehydrated at about 180° C. for about 12 hrs. Pure Al (about 99.93%) was melted at about 820° C. in a graphite crucible (with an inner diameter of about 40 mm and a height of about 80 mm) in a furnace under Ar protection. The mixed powders were loaded onto the surface of the Al melt with a volume ratio of TiC nanoparticles to Al at about 15:85. After about 3-5 min, the salt started melting. A titanium stirrer with four blades (about 25.4 mm in diameter) was applied at an about ⅔ height of the liquid melt to stir the melt at about 200 rpm for about 10 min. The melt was then cooled to room temperature in air. The solidified nanocomposites were cut to obtain the Al—TiC nanocomposite samples.

Figure 6:
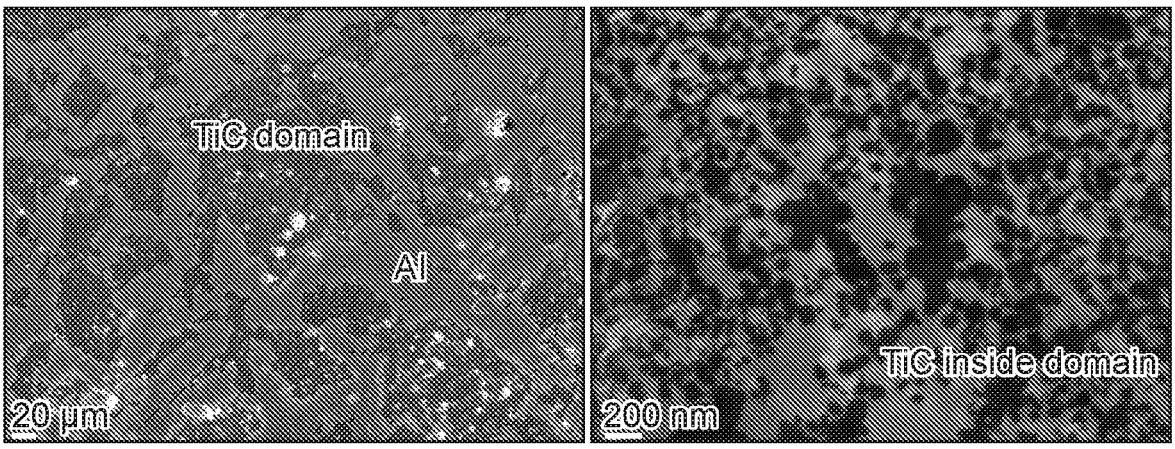
FIG. 6. Domains (patches) of TiC nanoparticles inside Al matrix and TiC nanoparticles (dark) inside one domain.

The nanocomposite samples were subjected to grinding and ion milled to expose the microstructure and embedded nanoparticles. The microstructure of the samples was studied with Field Emission SEM (Zeiss Supra 40) with energy dispersive spectrometry (EDS). FIG. 6 shows the typical domains of TiC nanoparticles inside the Al matrix and the TiC nanoparticle distribution inside the domain.

Quantitative Analysis of TiC Nanoparticle Loading in Al:

TiC nanoparticle concentrations in Al were determined. Two Al—TiC nanocomposite samples were cut and cleaned by alcohol. The masses of the nanocomposite samples were measured by a precision scale to be about 0.814 g and about 0.779 g. The nanocomposite samples were then dissolved in about 12 vol. % HCl solution in two centrifuge tubes in an ice-water base. More than 3 times of HCl solution was used for about 48 hrs to ensure a complete dissolution of the Al matrix. The solution was then centrifuged at about 5000 rpm for about 10 min. The upper transparent liquid was collected for pH value check by a pH paper. More deionized water was then added into the centrifuge tube for repeated centrifuge processes until the pH value of the upper transparent liquid was about 7. Then pure alcohol was added to the centrifuge tube to clean the water residue on the surface of TiC nanoparticles during two more centrifuge cycles. Finally the TiC nanoparticles inside the tubes were dehydrated at about 180° C. for about 48 hrs before the weight measurement. The TiC fractions in the two samples were determined to be about 8.81 vol. % and about 9.25 vol. % respectively. Therefore, the TiC fraction in the nanocomposites is about 9.03 vol. % by average. Since the initial volume ratio of TiC nanoparticles to Al was designed to be about 15:85, the salt-assisted incorporation efficiency of TiC nanoparticle in Al melt was about 56%, which can be further improved by process optimization.

Figure 7:
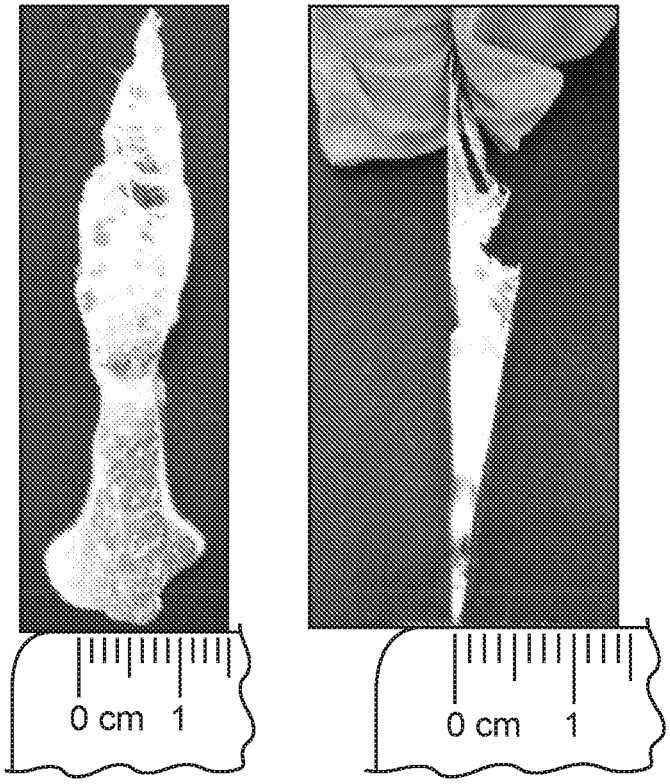
FIG. 7. Sample made by droplet casting.

Dispersion of TiC in Al in Droplet Casted Sample:

Al-9 vol. % TiC nanocomposite ingots were applied as a master alloy to fabricate Al-0.6 vol. % TiC nanocomposites. To avoid the sedimentation of TiC nanoparticle domains in Al, droplet casting was used. With ultrasonic on, the surface oxide layer was skimmed out and a steel spoon was used to quickly take Al melt of about 2 g for casting into a copper wedge mold to avoid potential sedimentation and pushing of TiC nanoparticles during fast solidification. The sample made by the droplet method is shown in FIG. 7. The cooling rate at the thickness din the copper wedge mold can be calculated as approximately $$\frac{1000\ \mathrm{K\,mm^2}}{\mathrm{s}}/\left(\frac{d}{2}\right)^2$$

The estimated cooling rate at the 0.5 mm thick section is about 16,000 K/s.

Figure 8:
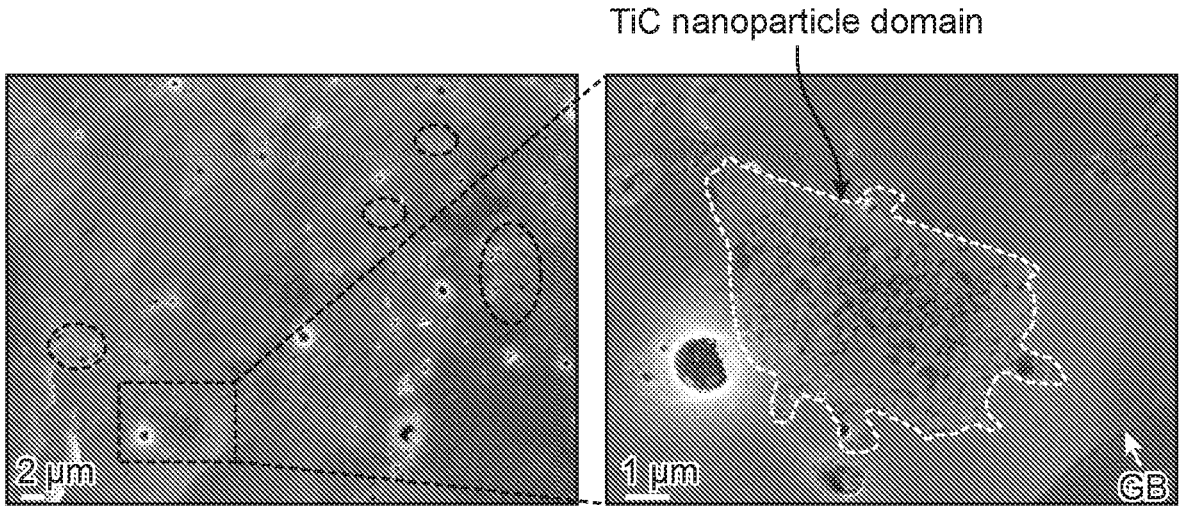
FIG. 8. (Left) Different domains of TiC nanoparticles circled with black discontinuous lines; and (right) higher magnification of a representative TiC nanoparticle domain inside a grain boundary.

FIG. 8 reveals the microstructure of the sample after solidification. TiC nanoparticles still formed domains inside the fast cooled Al matrix. Different domains were circled with black discontinuous lines in the left figure. Under a higher magnification, the representative domain indicates that TiC nanoparticles are most likely pseudo-dispersed in Al.

Dispersion of TiC Nanoparticles in Mg—Al Alloys:

Since TiC nanoparticles were pseudo-dispersed in pure Al, a melt with a lower Hamaker constant may facilitate achieving a self-dispersion of TiC nanoparticles. Semi-empirical results indicate that an alloy tend to have a lower Hamaker constant than its pure main metal element. Mg—Al alloy may offer a lower Hamaker constant than the pure Al. Experimental study was thus conducted.

Figure 9A:
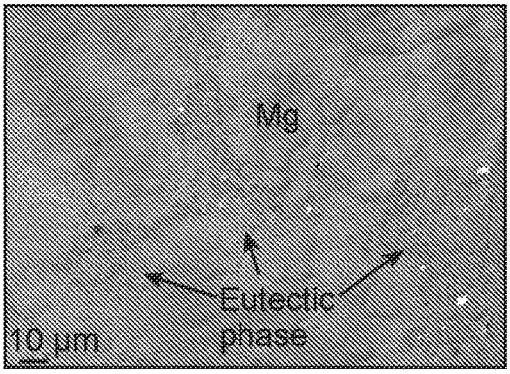
FIG. 9. TiC dispersion in eutectic phase in $Mg_{18}Al$-1.2 vol. % TiC nanocomposite.
Figure 9B:
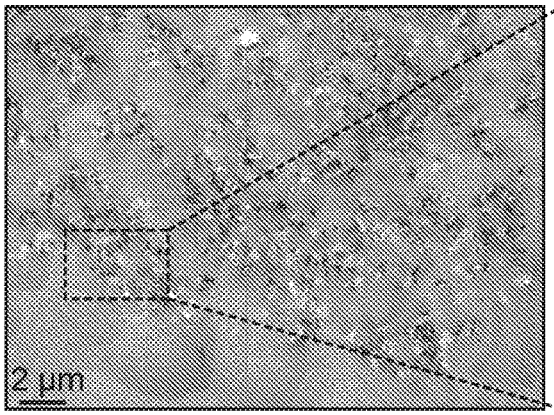
Figure 9C:
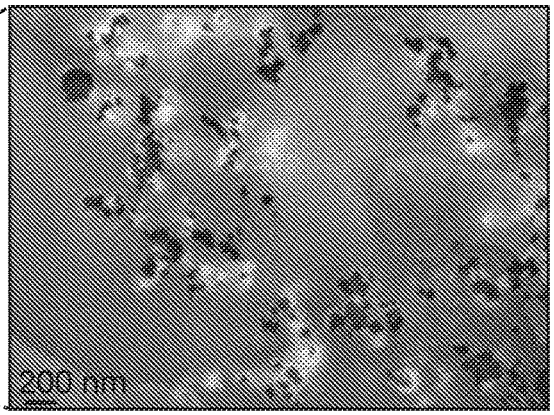

Al-9 vol. % TiC nanocomposite (about 24.3 g) was diluted inside Mg (about 88 g) at about 820° C. to yield $Mg_{18}$Al-1.2 vol. % TiC melt. After ultrasonic processing for about 15 min, the sample was solidified inside the crucible (about 1 K/s cooling rate) in air. FIG. 9 reveals the microstructure of the $Mg_{18}$Al-1.2 vol. % TiC nanocomposite. Mg grains and eutectic phases are shown in FIG. 9(*a*). Most TiC nanoparticles are located inside the eutectic phases, as shown in FIGS. 9(*b*) and (*c*). While there are still some short TiC nanoparticle networks, most TiC nanoparticles are actually dispersed and separated from one other. The result indicates that a better TiC dispersion was achieved inside the eutectic phase in $Mg_{18}$Al alloy (Mg+about 18 wt. % Al) than in the pure Al.

Figure 10:
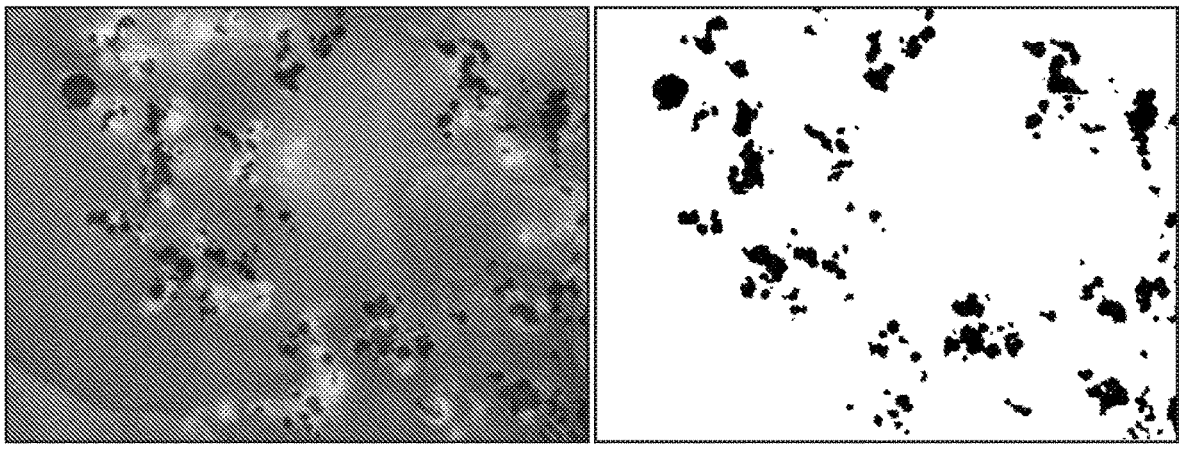
FIG. 10. ImageJ processed SEM image to quantitatively analyze nanoparticles dispersion.
Figure 11:
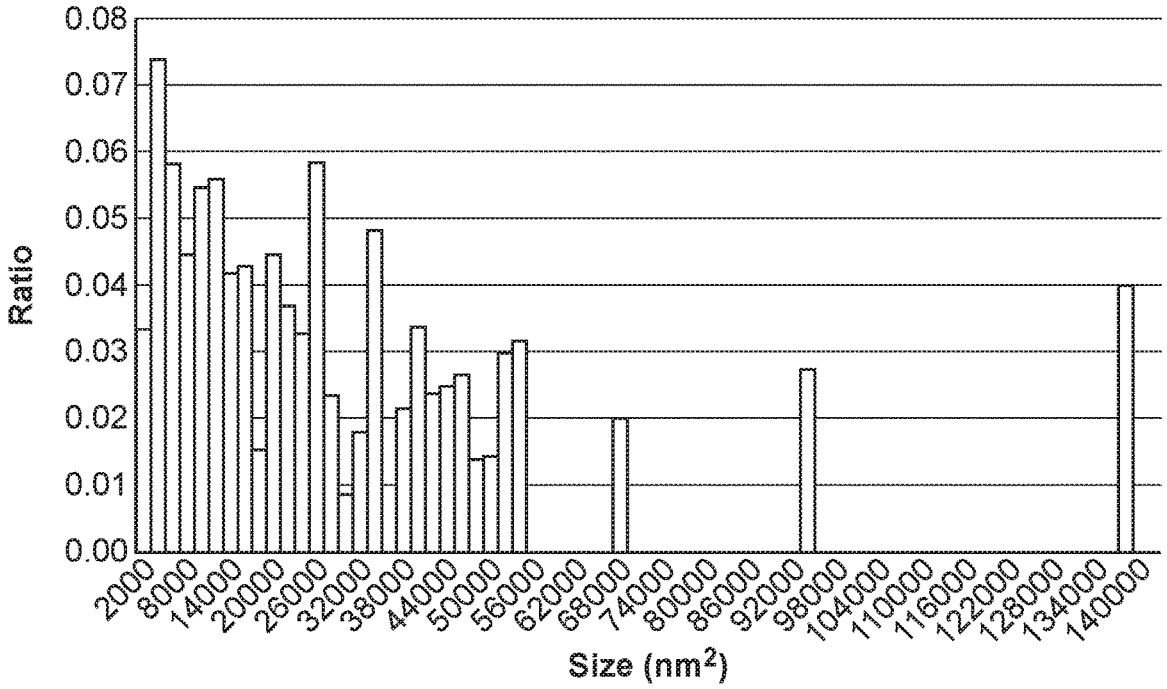
FIG. 11. Size distribution of TiC nanoparticle phases in $Mg_{18}Al$-1.2 vol. % TiC nanocomposite.
Figure 12:
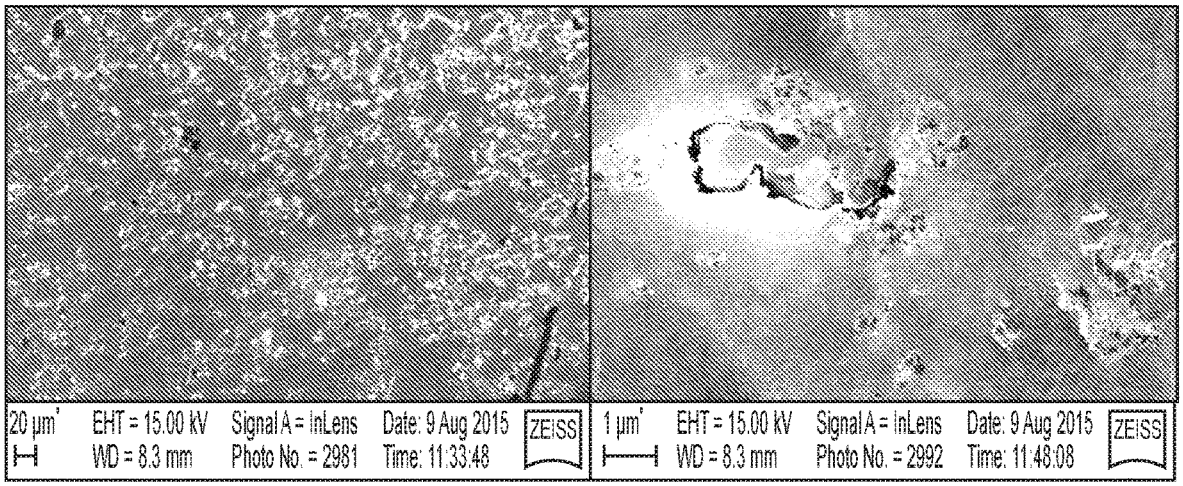
FIG. 12. Microstructure of $Mg_{29}Al$-1.98 vol. % TiC nanocomposite.
Figure 13:
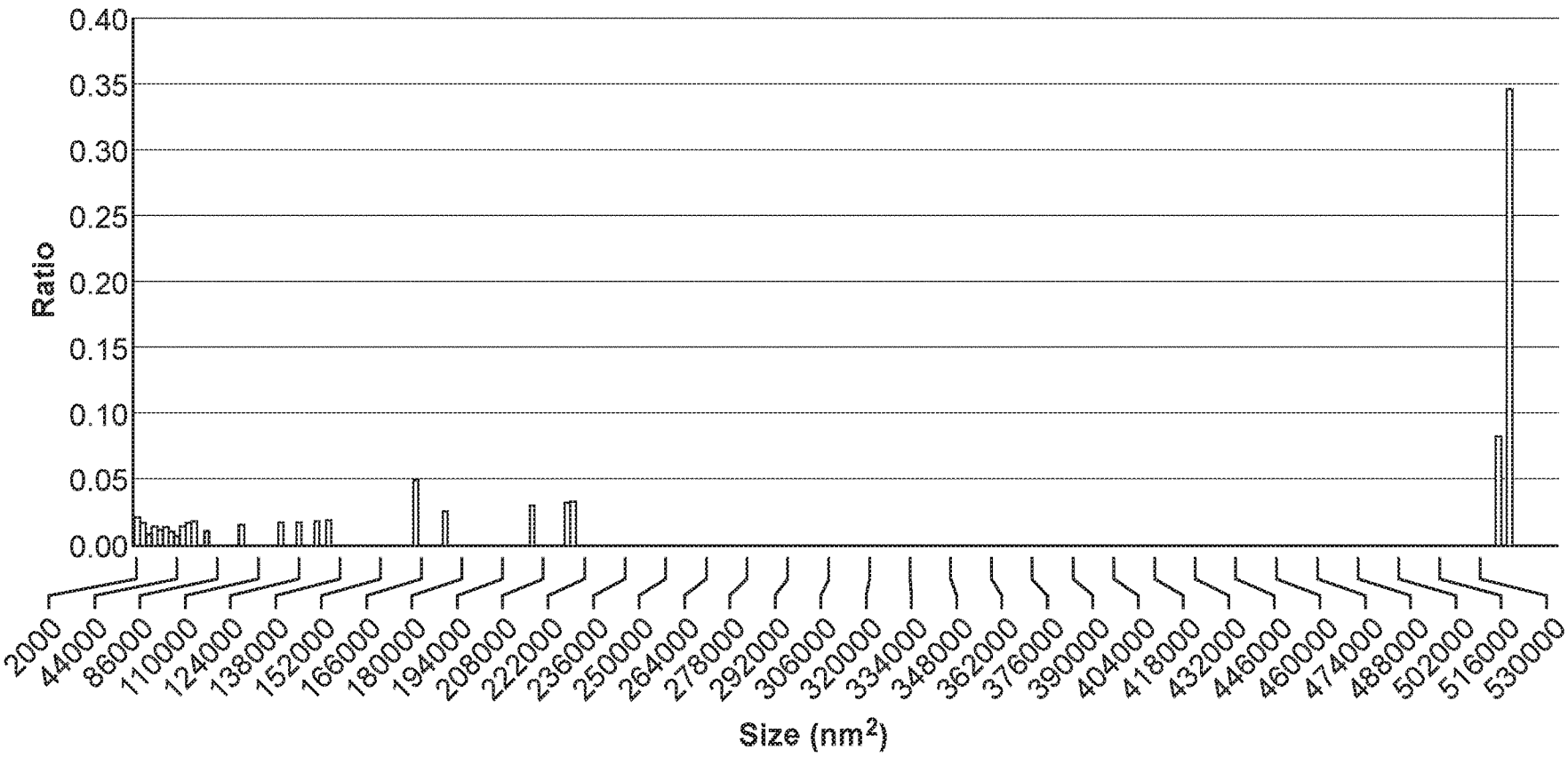
FIG. 13. Size distribution of TiC nanoparticle phases in $Mg_{29}Al$-1.98 vol. % TiC nanocomposite.
Figure 14:
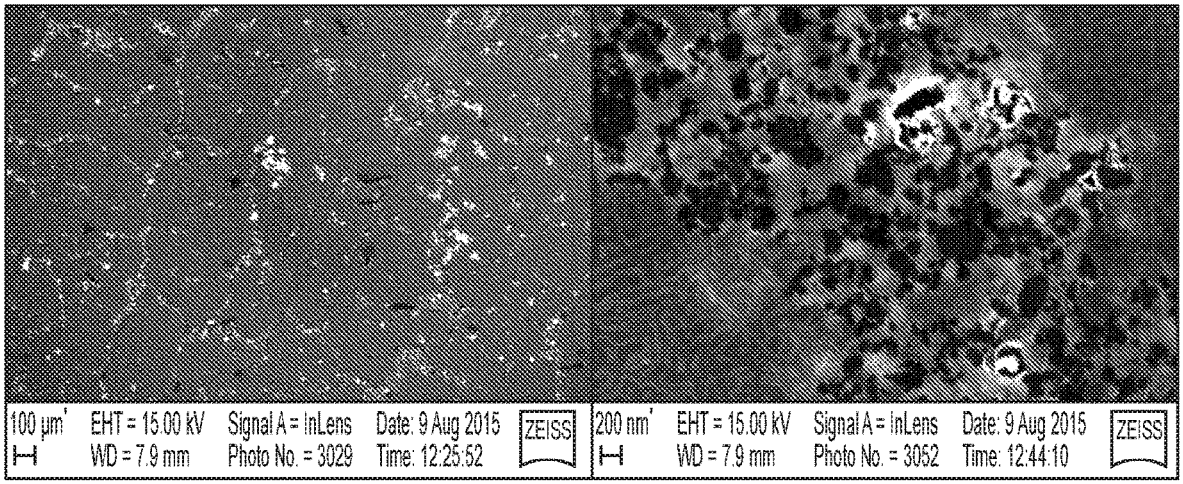
FIG. 14. Microstructure of $Mg_{42}Al$-3 vol. % TiC nanocomposite.
Figure 15:
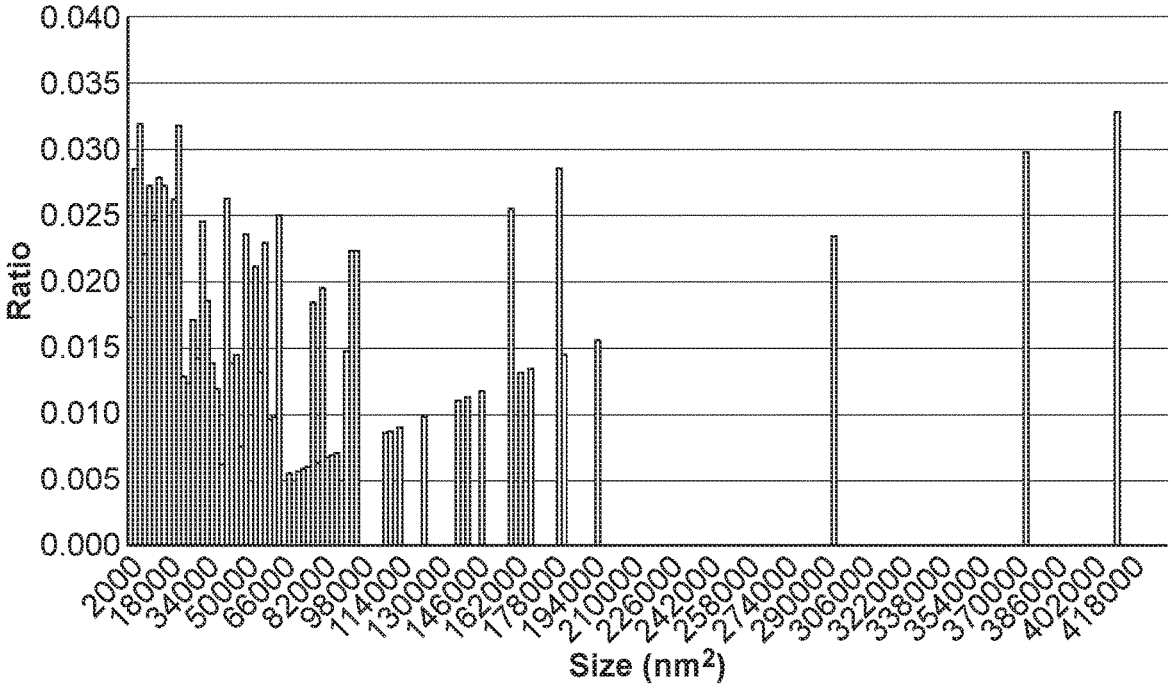
FIG. 15. Size distribution of TiC nanoparticle phases in $Mg_{42}Al$-3 vol. % TiC nanocomposite.
Figure 16:
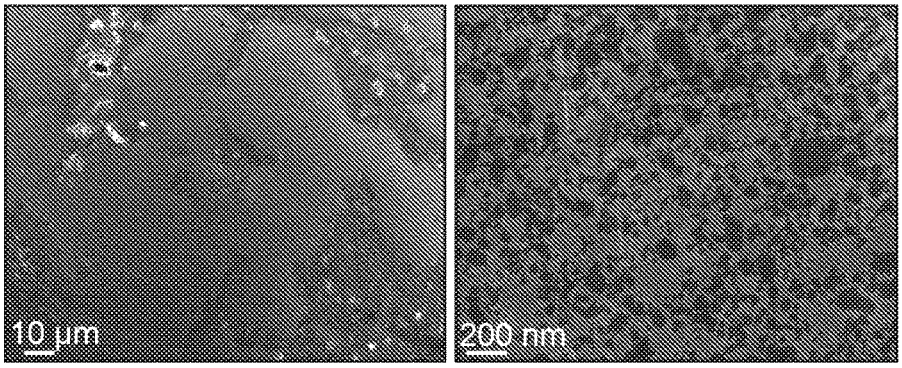
FIG. 16. Microstructure of $Mg_{88}Al$-7.5 vol. % TiC nanocomposite.
Figure 17:
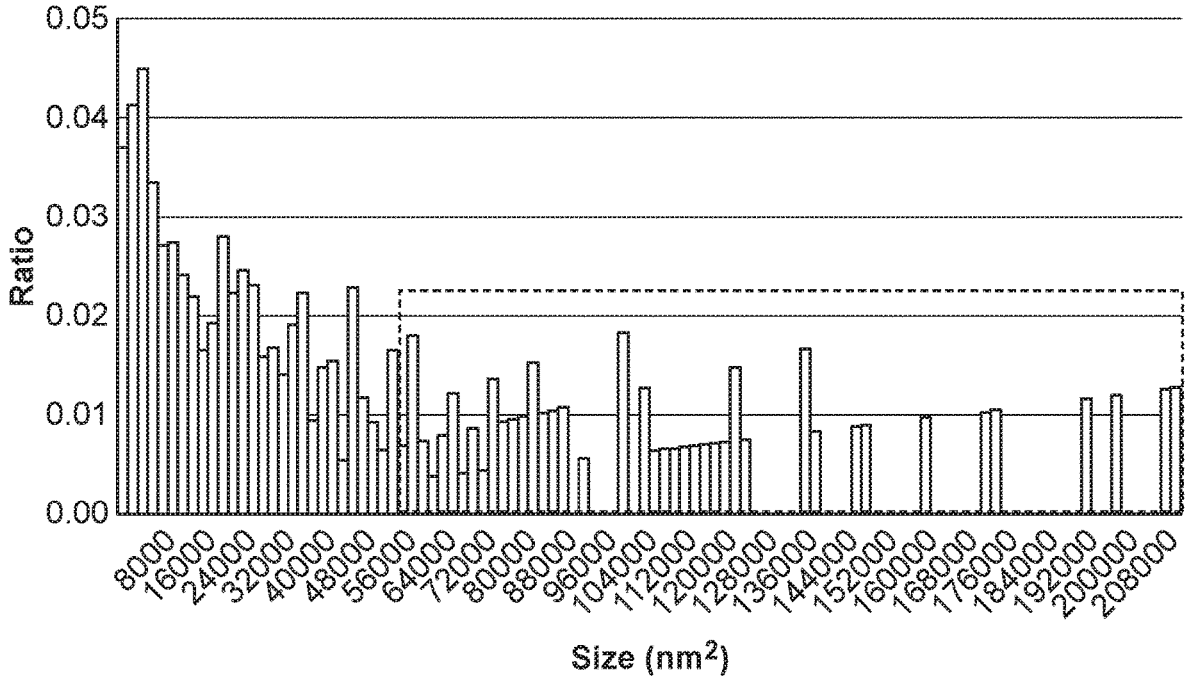
FIG. 17. Size distribution of TiC nanoparticle phases in $Mg_{88}Al$-7.5 vol. % TiC nanocomposite.

To quantitatively analyze the TiC dispersion in this sample, ImageJ was applied to measure a size distribution of TiC phases. One example of the processed images is presented in FIG. 10. The size distribution of TiC phases is shown in FIG. 11.

Further study was conducted on the dispersion of TiC with various Mg concentrations in Mg—Al alloys. The Mg concentration was reduced by evaporating Mg. $Mg_{18}$Al-1.2 vol. % TiC nanocomposites were melted at about 820° C. inside an induction heater under argon protection. The pressure was lowered to about 6 Torr, and the pressure and temperature were kept for about 10 min to allow Mg evaporation. Then the pressure was raised back to about 750 Torr for the sample to cool down to room temperature. The mass of the sample was reduced from about 10.3 g to about 6.72 g (about 3.58 g loss). A small piece was cut for characterization and the composition of the alloy is determined to be $Mg_{29}$Al (Mg+about 29 wt. % Al). The surface oxidation was polished off and the above evaporation procedure was repeated. After a second round of about 10 min evaporation, the mass of the sample was reduced from about 6.15 g to about 4.39 g (about 1.76 g loss), resulting in an alloy composition of $Mg_{42}$Al (Mg+about 42 wt. % Al). The surface oxidation was polished off and the above evaporation procedure was repeated for another about 40 min. The mass of the sample was further reduced from about 3.50 g to about 1.81 g (about 1.69 g loss), resulting in an alloy composition of $Mg_{88}$Al (Mg+about 88 wt. % Al). A small piece of sample was cut for characterization (1 hr sample).

The microstructure and the size distribution of TiC nanoparticles in $Mg_{29}$Al-1.98 vol. % TiC, $Mg_{42}$Al-3 vol. % TiC, and $Mg_{88}$Al-7.5 vol. % TiC are shown in FIG. 12 to FIG. 17.

After 1 hr evaporation, the fraction of the TiC phase size over 56000 $nm^2$ in the $Mg_{88}$Al-7.5 vol. % TiC was over about 41.7% while just about 8.7% in the original $Mg_{18}$Al-1.2 vol. % TiC. The size of TiC clusters increases possibly due to the higher Al content (thus higher Hamaker constant), higher nanoparticle concentration, and more attraction and coagulation among nanoparticles during the evaporation.

Summary of TiC Nanoparticle Dispersion in Al:

Due to the range of the reported Hamaker constants for Al, theoretical analysis predicted the TiC dispersion as either pseudo-dispersion or self-dispersion. To avoid burning and surface oxidation for TiC nanoparticle incorporation into Al melts, a salt-assisted incorporation method was developed to fabricate Al-9 vol. % TiC master nanocomposites, which were used for dilution to a lower nanoparticle loading in final alloy melts. The quantitative determination of TiC volume fraction in the Al matrix was achieved through the HCl acid dissolution of Al alloys to extract TiC nanoparticles. Droplet casting method was then applied to avoid nanoparticle settling and pushing during solidification. In the droplet-casted samples, TiC nanoparticles formed domains in the Al matrix, indicating a pseudo-dispersion of TiC in Al melts. However, in an effort to lower the Hamaker constant by adding Mg, it was determined that TiC nanoparticle disperse well in the eutectic phase in the $Mg_{18}Al$ alloy.

Example 2

TiC Nanoparticles Dispersion in Al Melt

Figure 18:
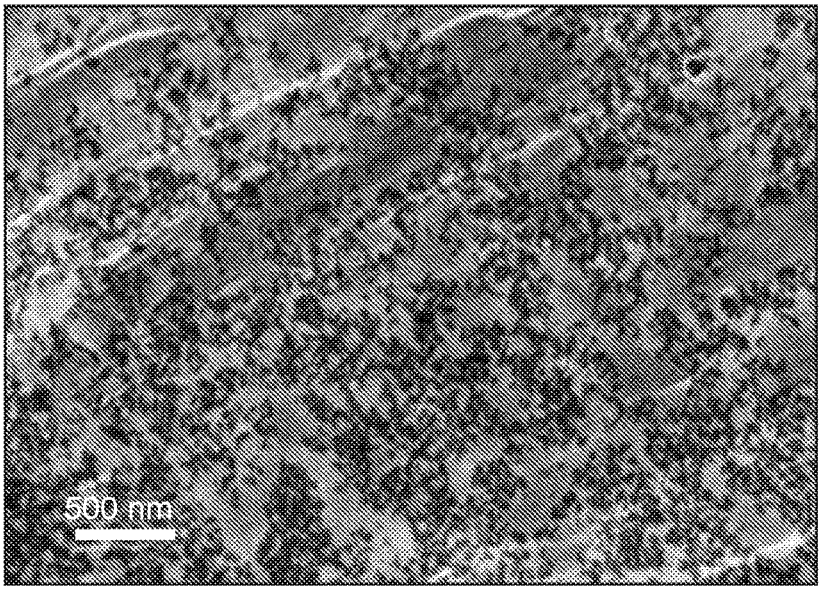
FIG. 18. SEM image of Al-13 vol. % TiC sample (dark particles: TiC; light matrix: Al).

A uniform dispersion of a high volume fraction of TiC nanoparticles (with sizes of about 3-10 nm) in Al matrix was achieved by liquid state processing. Specifically, Al with about 13 vol. % TiC was fabricated. Al was melted at about 820° C. under argon gas protection, and the TiC nanoparticles were added into the Al melt and subjected to mechanical mixing for about 20 min. After mixing, the sample was cooled down in air at a rate of about 1 K/s. The dispersion of the TiC nanoparticles in the Al matrix is characterized by SEM in FIG. 18. Through use of smaller particle sizes, the energy barrier $W_2$ remains much higher than the thermal energy while the energy well $W_1$ is reduced to mitigate against trapping of TiC nanoparticles, allowing TiC nanoparticles to be self-dispersed in the Al melt.

Example 3

SiC Nanoparticles Dispersion in Mg Melt

Theoretical analysis of SiC nanoparticles dispersion in Mg melt:

For two SiC nanoparticles interacting in a pure Mg melt at about 1000 K, the Hamaker constants, $A_{SiC}$ and $A_{Mg}$, are about 248 zJ and about 206 zJ for SiC and Mg melt respectively. Their Brownian potential (thermal energy) is kT=about 13.8 zJ at about 1000 K.

The van der Waals interaction between two same SiC nanoparticles with a radius of R in Mg is $$W_{vdw}(D) = -\frac{\left(\sqrt{248} - \sqrt{206}\right)^2}{6D}\frac{R}{2}$$

The unit of D and R is nm while the unit of $W_{vdw}(D)$ is zJ. The above equation is effective when two SiC nanoparticles interact through the liquid Mg when D is larger than two atomic Mg layers (e.g., about 0.4 nm).

According to the Langbein approximation, if the effective interaction area of two spheres is $$S = 2\pi\frac{R_1R_2}{R_1 + R_2}D_0,$$

the interfacial energy barrier will be $$W_{inter}(D) = 2S(\sigma_p - \sigma_{pl})e^{-(D-D_0)/a_0}\frac{D - a_0}{D_0 - a_0}$$

for $D_0 < D < a_0$ $$W_{inter}(D) = -2S\sigma_p e^{D/a_0}(1 - D/D_0) + 2S(\sigma_p - \sigma_{pl})$$

for $0 < D < D_0$

But before interfacial energy dominates, the local minimum $W_1$ (energy well for attraction) is $$W_1 = W_{vdw}(d_1) = -\frac{\left(\sqrt{A_{SiC}} - \sqrt{A_{Mg}}\right)^2}{6d_1}\left(\frac{R_1R_2}{R_1 + R_2}\right) = -\frac{\left(\sqrt{248} - \sqrt{206}\right)^2}{6d_1}\frac{R}{2}$$

Assuming $d_1$ is the decaying length of interfacial energy, about 0.4 nm, and when R is about 30 nm for the SiC nanoparticles used for this example, then $$W_1 = W_{vdw}(d_1) = -\frac{\left(\sqrt{248} - \sqrt{206}\right)^2}{6d_1}\frac{R}{2} = -12.17\ \text{zJ} > -\text{kT}$$

From the literature, the surface energy of liquid Mg is about 0.599 $J/m^2$ and the surface energy of SiC is about 1.45 $J/m^2$. The contact angle is about 83°. The interfacial energy between liquid Mg and SiC will be about 0.422 $J/m^2$ according to Young's equation. The local maximum $W_2$ due to the interfacial energy will be $$W_2 = W_{inter}(D_0) = 4\pi\frac{R_1R_2}{R_1 + R_2}D_0(\sigma_p - \sigma_{pl})e^{-(D_0-D_0)/a_0}\frac{D - a_0}{D_0 - a_0} = 38.74\times10^3\ \text{zJ} > 2800\ \text{kT}$$

Since the local maximum $W_2$ is far larger than 10 kT, there will be little chance for SiC nanoparticles to overcome the energy barrier to form clusters.

Thus, for two SiC nanoparticles with a radius of about 30 nm in a pure Mg melt, the energy barrier $W_2$ is much higher than the thermal energy while the energy well $W_1$ is not enough to trap SiC nanoparticles, allowing SiC nanoparticles to be self-dispersed in the pure Mg melt.

Figure 19A:
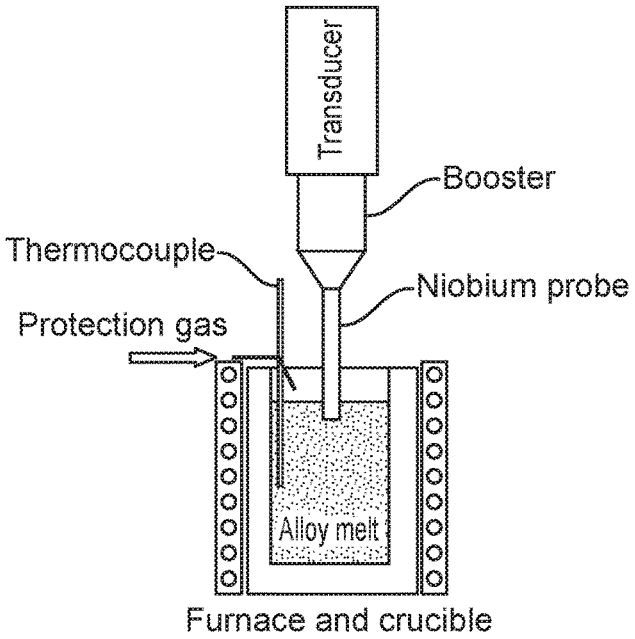
FIG. 19. Schematic of the experimental setup (a) Ultrasonic processing for $Mg_6Zn$-1 vol. % SiC nanocomposites fabrication; and (b) Evaporation for concentrating nanoparticles in Mg.
Figure 19B:
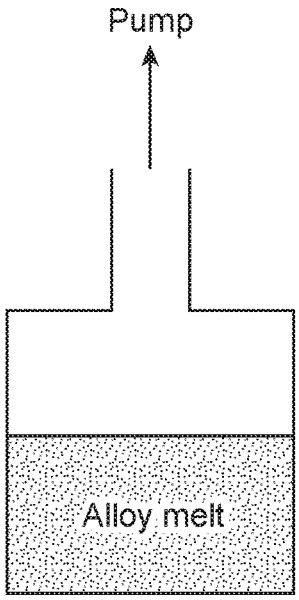

Fabrication of Nanocomposites of $Mg_2Zn$ with about 14 Vol. % SiC Nanoparticles:

A uniform dispersion of a high volume fraction of SiC nanoparticles (with an average radius of about 30 nm) in Mg matrix was achieved by liquid state processing. The schematic of the experimental setup is shown in FIG. 19. $Mg_6Zn$ with about 1 vol. % SiC was first fabricated through ultrasonic processing. Pure Mg (about 99.93%) and pure Zn (about 99.0%) were melted together at about 700° C. in a furnace under $SF_6$ (about 99 vol. %)/$CO_2$ (about 1 vol. %) flow gas protection. The tip of a niobium ultrasonic probe was inserted about 6 mm in depth into the melt. An ultrasonic vibration with a frequency of about 20 kHz and a peak-to-peak amplitude of about 60 μm was generated from a transducer. The melt was ultrasonically processed for about 15 minutes. The SiC nanoparticles are manually fed into the $Mg_6Zn$ (Mg+about 6 wt. % Zn) melt, wetted and dispersed by ultrasonic processing. After the ultrasonic processing, the sample was cooled down to room temperature in air.

Figure 20:
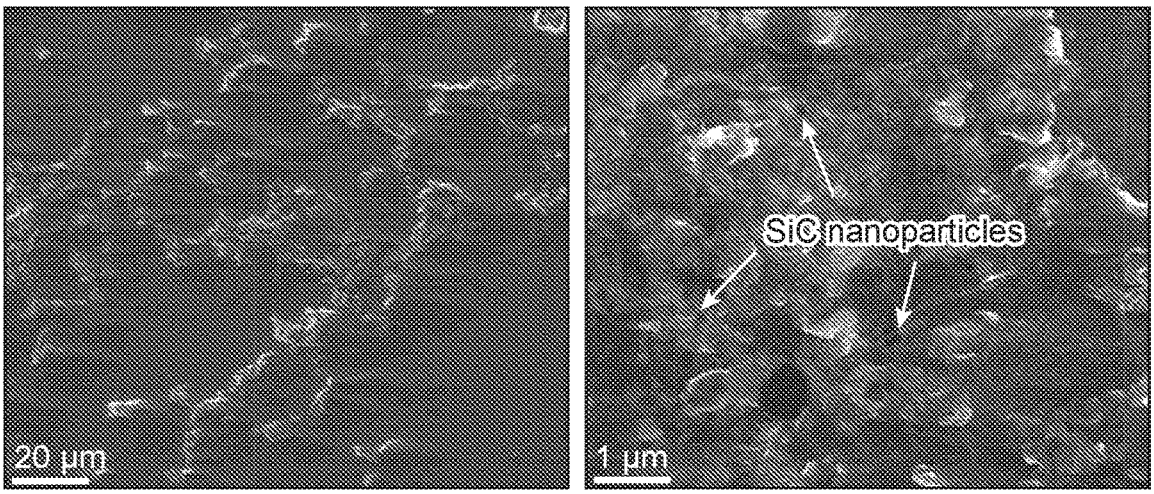
FIG. 20. Nanoparticles pushed into intermetallic phase in $Mg_6Zn$.

The distribution and dispersion of nanoparticles in the as-solidified $Mg_6Zn$ matrix is characterized by SEM in FIG. 20. With about 1 vol. % SiC nanoparticles, nanoparticles were pushed into intermetallic phase in the $Mg_6Zn$ alloy. The pushing of nanoparticles by the solidification front can be effectively countered by a higher viscosity drag force in the melt via the introduction of a higher volume fraction of nanoparticles (e.g., >about 6 vol. %). Therefore, to reveal the true dispersion of SiC in Mg, a high volume fraction of nanoparticles in the Mg is desirable.

To achieve a high volume fraction of nanoparticles in the Mg melt, the nanoparticles were concentrated by evaporating away Mg and Zn from the $Mg_6Zn$-1 vol. % SiC samples at about 6 Torr in a vacuum furnace. The evaporation process is schematically shown in FIG. 19(*b*). $Mg_6Zn$-1 vol. % SiC was first melted at about 650° C. under Ar gas protection inside an induction heater before Mg and Zn were evaporated from the alloy melt at about 6 Torr. After evaporation, the sample was cooled to room temperature in the furnace under a gas pressure of about 760 Torr to obtain about 14 vol. % SiC in $Mg_2Zn$ (Mg+about 2 wt. % Zn). The pushing of SiC nanoparticles by the solidification front was effectively countered by a higher viscosity drag force in the melt. Therefore, the dispersion of SiC nanoparticles in the $Mg_2Zn$ melt was maintained through the solidification inside the $Mg_2Zn$ matrix.

Figure 21A:
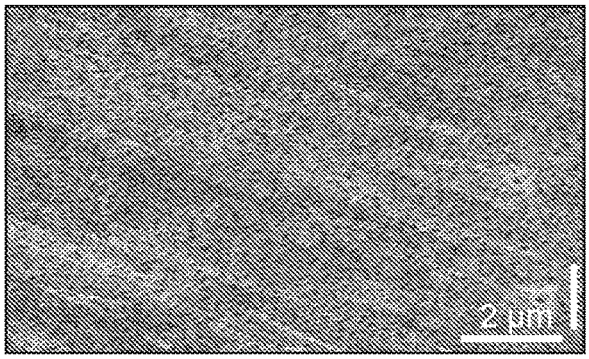
FIG. 21. (a)(b) SEM images of Mg-14 vol. % SiC sample acquired at about 52 degrees tilt angle and at different magnification; and (c) Uniform distribution of nanoparticles across the whole sample.
Figure 21B:
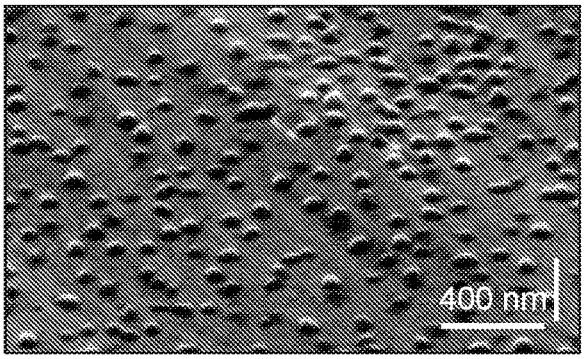
Figure 21C:
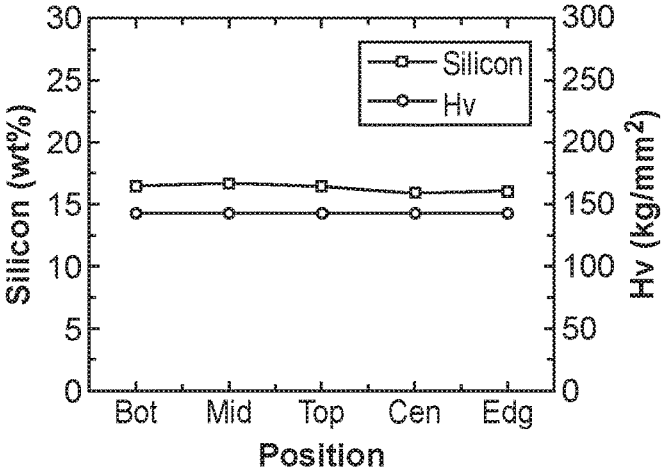

Self-Dispersion of about 14 Vol. % SiC in $Mg_2Zn$:

The distribution and dispersion of nanoparticles in $Mg_2Zn$-14 vol. % SiC were characterized by SEM. The chemical composition was determined by EDX (Energy dispersive X-ray spectroscopy) analysis. To reveal the nanoparticles clearly, the samples were first cleaned by low angle ion milling (about 10 degrees, to remove the nano-sized polishing powders) and then slightly etched by gallium ions (about 90 degrees, to preferentially etch magnesium matrix) by a focused ion beam. The SEM images were taken with a tilt angle of about 52 degrees. From the SEM image as shown in FIG. 21, the nanoparticles exposed on the surface of the $Mg_2Zn$ matrix distribute and disperse uniformly in the Mg matrix. Vickers hardness measurements were made under a load of about 500 gram force with a dwelling time of about 10 s. The microhardness and silicon concentration at different parts of the sample were measured to further confirm that the nanoparticles were distributed uniformly in the whole sample, as shown in FIG. 21(*c*). More generally, a uniform distribution of nanoparticles in a sample can be reflected by a standard deviation of a characteristic, such as the microhardness or a concentration of a nanoparticle material, at different parts of the sample being less than or equal to 10% of an average value of the characteristic across the different parts of the sample, such as less than or equal to 5%, less than or equal to 4%, less than or equal to 3%, less than or equal to 2%, less than or equal to 1%, less than or equal to 0.5%, less than or equal to 0.1%, or less than or equal to 0.05%.

To investigate the property enhancement induced by the dispersed nanoparticles at high volume fraction, in-situ micro-pillar compression testing in SEM is conducted on as-solidified samples. Micro-compression tests on samples with diameter of about 4 μm and height of about 8 μm were conducted using a PI 85 SEM PicoIndenter (Hysitron, Inc., USA) with an about 8 μm flat punch diamond probe inside an SEM (Nova 600, FEI, USA) using the displacement control mode at a strain rate of about $2\times10^{-3}$ $s^{-1}$. The micro-pillars were cut from bulk samples by FIB (Nova 600, FEI). The size of the micro-pillar (about 4 μm in diameter and about 8 μm in length) was designed to contain just one grain to avoid the effect of grain boundaries on strengthening. This allows evaluation of the property enhancement induced just by nanoparticles without the interference of grain boundaries for the cast samples. The size of the micro-pillar was also selected to avoid size-induced strengthening in order to provide results comparable to macro-scale tests for magnesium alloys. To investigate the effect of nanoparticles on basal slip, the orientation of the pillars was chosen to favor basal slip.

Figure 22A:
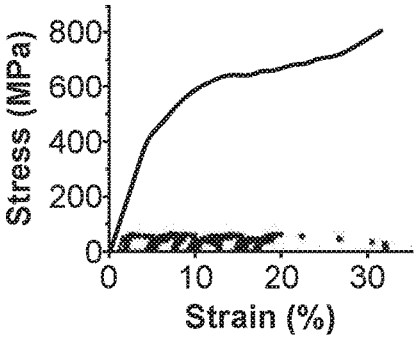
FIG. 22. Mechanical behavior of as-solidified samples at room temperature. (a) Engineering stress-strain curves of micro-pillar as-solidified samples without (bottom) and with (top) nanoparticles; and (b)(c) SEM images showing the morphology of post-deformed samples without (b) and with (c) nanoparticles.
Figure 22B:
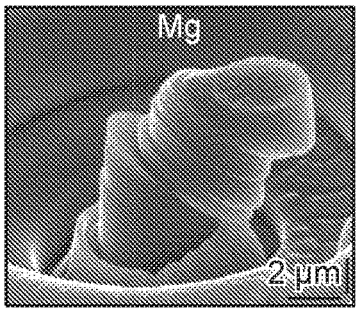
Figure 22C:
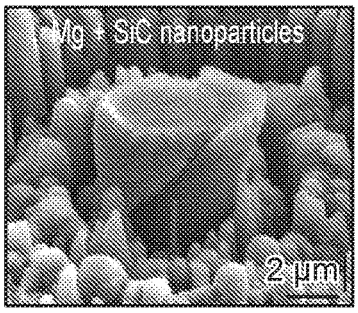

The results from micro-compression tests show that the $Mg_2Zn$ samples without nanoparticles yield at about 50 MPa, then experience repeated loading-unloading cycles due to severe basal slipping, as shown in FIGS. 22(*a*) and (*b*). In contrast, the samples with nanoparticles yield at a significantly higher strength of about 410 MPa, and bear gradually increasing load smoothly to a plastic strain of over about 30%, as shown in FIGS. 22(*a*) and (*c*). Moreover, after deformation, multiple slip traces are observed in the samples without nanoparticles (FIG. 22(*b*)), but just one major slip trace developed at the later stage of deformation is observed in the samples with nanoparticles (FIG. 22(*c*)). Even after the formation of the major slip trace, the samples with nanoparticles can still bear load smoothly. The testing results demonstrate that the high volume fraction of the dispersed nanoparticles can significantly strengthen the material and also can afford a more uniform and stable deformation by potentially suppressing basal slip.

Summary on Self-Dispersion of SiC in Mg:

Theoretical analysis predicts that SiC nanoparticles can be self-dispersed in Mg melt. Experimental study was conducted. $Mg_2Zn$-14 vol. % SiC nanocomposites were successfully fabricated through a two-step liquid processing method. Firstly, $Mg_6Zn$-1 vol. % SiC nanocomposites were fabricated by ultrasonic processing. Then, $Mg_2Zn$-14 vol. % SiC nanocomposites were achieved through an evaporation of Mg and Zn to concentrate SiC nanoparticles in the Mg melt. SEM images, EDS of Si composition, and Vickers hardness measurements show that the SiC nanoparticles were self-dispersed and stabilized in Mg. Micro-pillar compression test shows the $Mg_2Zn$-14 vol. % SiC nanocomposites yield at a significantly higher strength of about 410 MPa with a good plasticity, while just 50 MPa with a poor plasticity for pure Mg.

Example 4

NbC Nanoparticles Dispersion in Fe Melt

Figure 23:
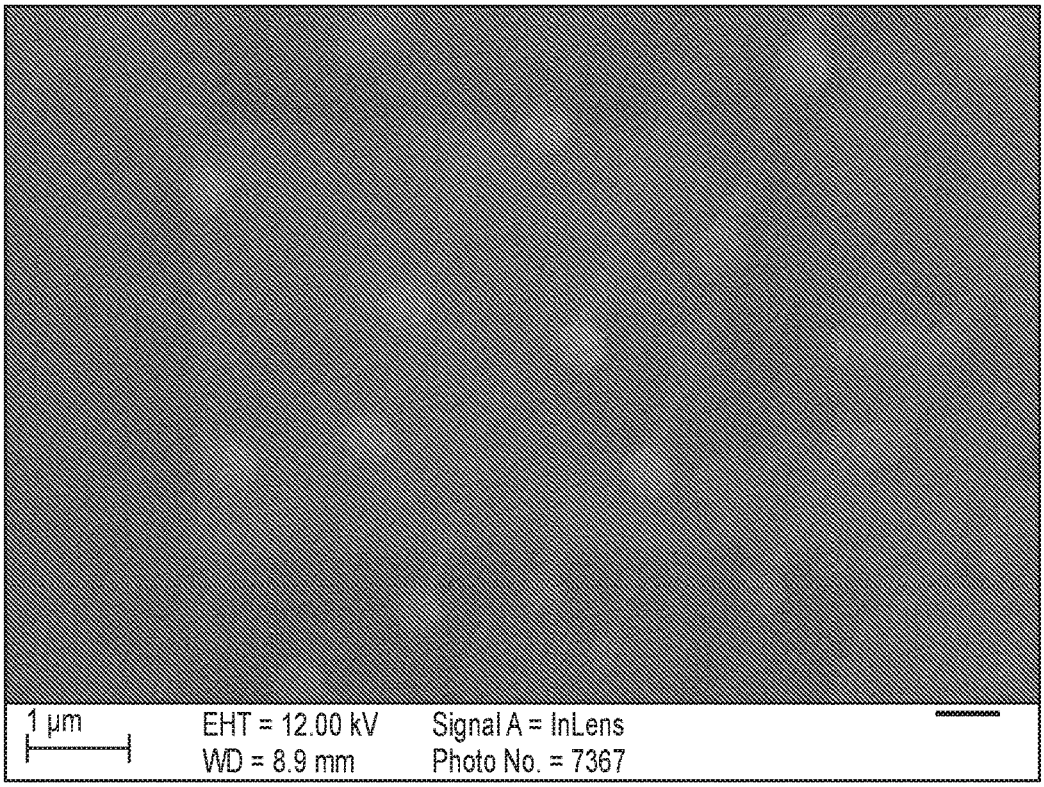
FIG. 23. SEM image of NbC nanoparticles dispersed in Fe matrix (light particles: NbC; dark matrix: Fe).

A nanocomposite of NbC nanoparticles in Fe matrix was achieved by liquid state processing. Fe was melted at about 1570° C. in a vacuum furnace, and about 3 wt. % NbC nanoparticles and about 1 wt. % carbon were introduced into the Fe melt and subjected to mixing. After mixing, the sample was cooled down slowly in vacuum (about $2\times10^{-2}$ Torr). The dispersion of the NbC nanoparticles in the Fe matrix is characterized by SEM in FIG. 23. As can be seen, the NbC nanoparticles are well dispersed in the Fe matrix.

Example 5

$TiB_2$ Nanoparticles Dispersion in Al Melt

Theoretical Analysis of $TiB_2$ Nanoparticles Dispersion in Al Melt:

For two $TiB_2$ nanoparticles interacting in a pure Al melt at about 820° C., the Hamaker constants, $A_{TiB2}$ and $A_{Al}$, are about 256 zJ and about 266 zJ for $TiB_2$ and Al melt respectively. Their Brownian potential (thermal energy) is kT=about 15.1 zJ at about 820° C. A contact angle of Al melt on $TiB_2$ surface is about 150° at about 690° C., about 67° at about 800° C., and about 0° at about 1100° C.

The local minimum $W_1$ (enemy well for attraction) is $$W_1 = W_{vdw}(d_1) = -\frac{\left(\sqrt{A_{TiB_2}} - \sqrt{A_{Al}}\right)^2}{6d_1}\left(\frac{R_1 R_2}{R_1 + R_2}\right) > -\mathrm{kT}$$

and the local maximum $W_2$ due to the interfacial energy will be $W_2 = W_{inter}(D_o) > 10$ kT for $R_1 = R_2 = R$ in a range of about 0.254 nm to about 880 nm.

Thus, for two $TiB_2$ nanoparticles with a radius in the above-stated range in a pure Al melt, the energy barrier $W_2$ is much higher than the thermal energy while the energy well $W_1$ is not enough to trap $TiB_2$ nanoparticles, allowing $TiB_2$ nanoparticles to be self-dispersed in the pure Al melt.

Figure 24:
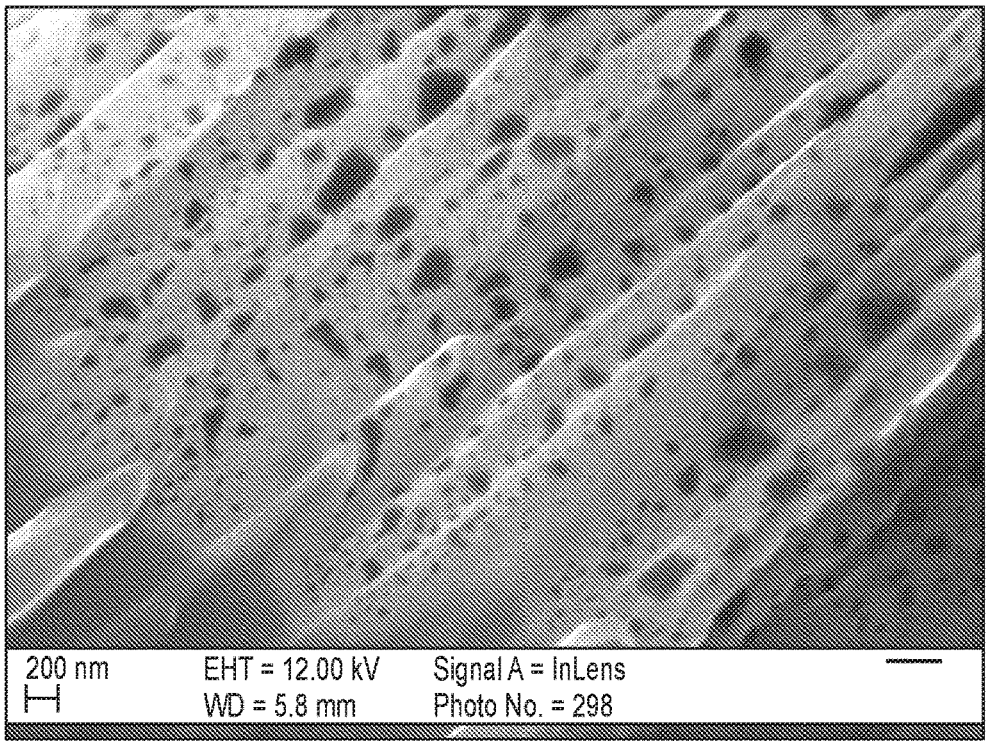
FIG. 24. SEM image of Al-5 vol. % $TiB_2$ sample (dark particles: $TiB_2$; light matrix: Al).

Fabrication of Nanocomposite of Al with about 5 Vol. % $TiB_2$ Nanoparticles:

A uniform dispersion of $TiB_2$ nanoparticles (with an average size of about 40 nm and a smallest size of about 5 nm) in Al matrix was achieved by liquid state processing. Specifically, Al with about 5 vol. % $TiB_2$ was fabricated. Al was melted at about 820° C. under argon gas protection, and the $TiB_2$ nanoparticles were manually added into the Al melt and subjected to mechanical mixing at about 200 rpm for about 20 min. After mixing, the sample was cooled down in air at a rate of about 1 K/s. The dispersion of the $TiB_2$ nanoparticles in the Al matrix is characterized by SEM in FIG. 24.

Example 6

W Nanoparticles Dispersion in Ag Melt

Theoretical Analysis of W Nanoparticles Dispersion in Ag Melt:

For two W nanoparticles interacting in a pure Ag melt at about 1200° C., the Hamaker constants, $A_W$ and $A_{Ag}$, are about 400 zJ and about 440 zJ for W and Ag melt respectively. Their Brownian potential (thermal energy) is kT=about 20.3 zJ at about 1200° C.

The local minimum $W_1$ (energy well for attraction) is $$W_{vdw} = -\frac{\left(\sqrt{A_W} - \sqrt{A_{Ag}}\right)^2}{12}\frac{R}{d_1} = -0.08\frac{R}{d_1}$$

where $W_1 > -\mathrm{kT}$ for R in a range encompassing 10 nm, 20 nm, 30 nm, and 40 nm. Thus, for two W nanoparticles with a radius in the above-stated range in a pure Ag melt, the energy well $W_1$ is not enough to trap W nanoparticles, allowing W nanoparticles to be self-dispersed in the pure Ag melt.

Figure 25:
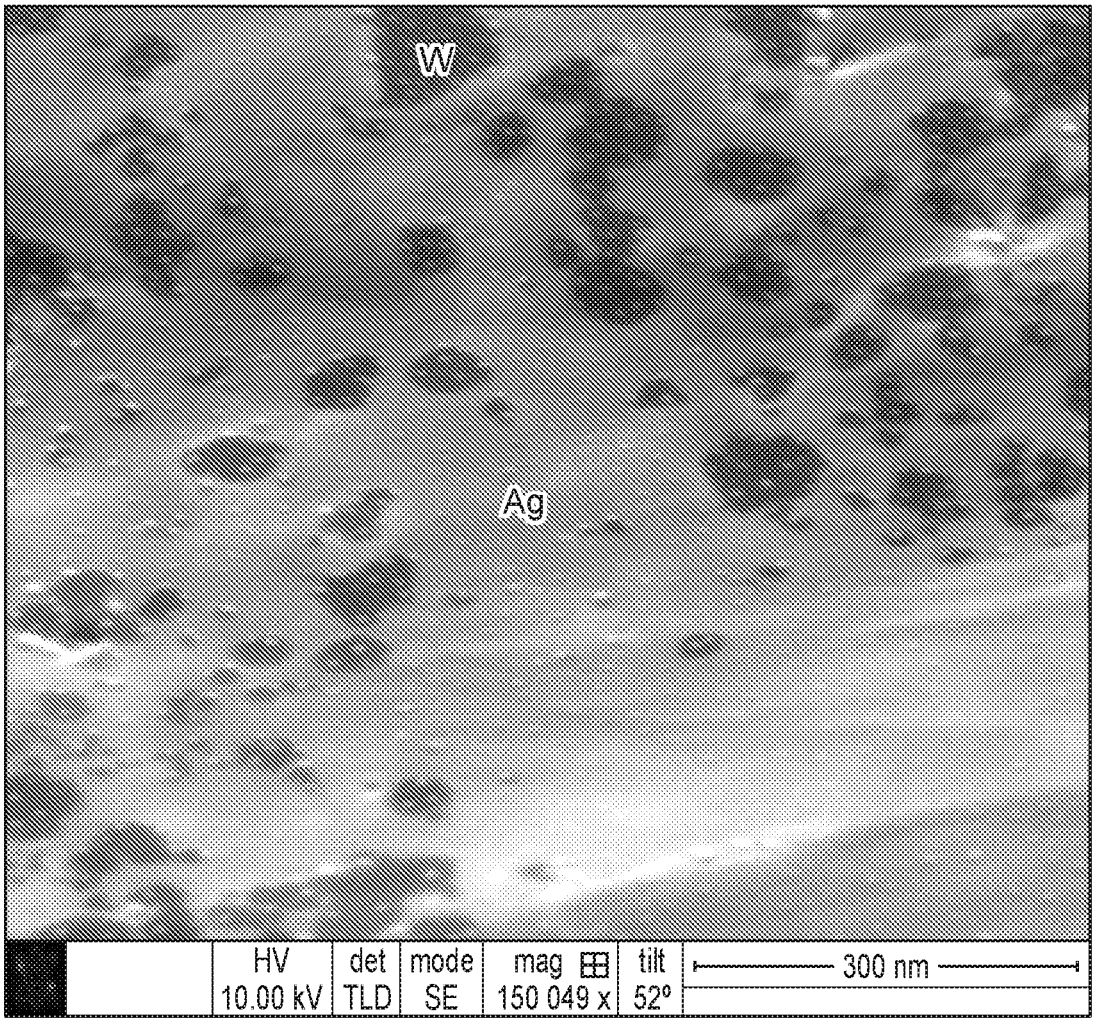
FIG. 25. SEM image of Ag-5 vol. % W sample (dark particles: W; light matrix: Ag).

Fabrication of Nanocomposite of Ag with about 5 Vol. % W Nanoparticles:

A uniform dispersion of W nanoparticles (with sizes of about 40 nm to about 60 nm) in Ag matrix was achieved by liquid state processing. Specifically, Ag with about 5 vol. % W was fabricated. Ag was melted at about 1200° C. under argon gas protection, and the W nanoparticles were introduced into the Ag melt. The sample was cooled down slowly in argon. The dispersion of the W nanoparticles in the Ag matrix is characterized by SEM in FIG. 25.

As used herein, the singular terms "a," "an," and "the" may include plural referents unless the context clearly dictates otherwise. Thus, for example, reference to an object may include multiple objects unless the context clearly dictates otherwise.

As used herein, the term "set" refers to a collection of one or more objects. Thus, for example, a set of objects can include a single object or multiple objects.

As used herein, the terms "substantially" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

As used herein, the terms "optional" and "optionally" mean that the subsequently described event or circumstance may or may not occur and that the description includes instances where the event or circumstance occurs and instances in which it does not.

As used herein, the term "size" refers to a characteristic dimension of an object. Thus, for example, a size of an object that is spherical can refer to a diameter of the object. In the case of an object that is non-spherical, a size of the non-spherical object can refer to a diameter of a corresponding spherical object, where the corresponding spherical object exhibits or has a particular set of derivable or measurable properties that are substantially the same as those of the non-spherical object. When referring to a set of objects as having a particular size, it is contemplated that the objects can have a distribution of sizes around the particular size. Thus, as used herein, a size of a set of objects can refer to a typical size of a distribution of sizes, such as an average size, a median size, or a peak size.

As used herein, the term "nanostructure" refers to an object that has at least one dimension in a range of about 1 nm to about 1000 nm. A nanostructure can have any of a wide variety of shapes, and can be formed of a wide variety of materials. Examples of nanostructures include nanofibers, nanoplatelets, and nanoparticles.

As used herein, the term "nanoparticle" refers to a nanostructure that is generally or substantially spherical or spheroidal. Typically, each dimension of a nanoparticle is in a range of about 1 nm to about 1000 nm, and the nanoparticle has an aspect ratio of about 5 or less, such as about 3 or less, about 2 or less, or about 1.

As used herein, the term "nanofiber" refers to an elongated nanostructure. Typically, a nanofiber has a lateral dimension (e.g., a width) in a range of about 1 nm to about 1000 nm, a longitudinal dimension (e.g., a length) in a range of about 1 nm to about 1000 nm or greater than about 1000 nm, and an aspect ratio that is greater than about 5, such as about 10 or greater.

As used herein, the term "nanoplatelet" refers to a planar-like, nanostructure.

As used herein, the term "alkaline earth metal" refers to a chemical element from Group 2 of the Periodic Table.

As used herein, the term "post-transition metal" refers to a chemical element from a group encompassing Al, Ga, In, Sn, Tl, Pb, and Bi.

As used herein, the term "transition metal" refers to a chemical element from Groups 3 to 12 on the Periodic Table.

Additionally, concentrations, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a range of about 1 to about 200 should be understood to include the explicitly recited limits of about 1 and about 200, but also to include individual values such as about 2, about 3, and about 4, and sub-ranges such as about 10 to about 50, about 20 to about 100, and so forth.

While the disclosure has been described with reference to the specific embodiments thereof, it should be understood by those skilled in the art that various changes may be made and equivalents may be substituted without departing from the true spirit and scope of the disclosure as defined by the appended claims. In addition, many modifications may be made to adapt a particular situation, material, composition of matter, method, operation or operations, to the objective, spirit and scope of the disclosure. All such modifications are intended to be within the scope of the claims appended hereto. In particular, while certain methods may have been described with reference to particular operations performed in a particular order, it will be understood that these operations may be combined, sub-divided, or re-ordered to form an equivalent method without departing from the teachings of the disclosure. Accordingly, unless specifically indicated herein, the order and grouping of the operations are not a limitation of the disclosure.

What is claimed is:

1. A bulk metal matrix nanocomposite comprising:

a bulk metal matrix including one or more metals; and nanostructures uniformly dispersed throughout the bulk metal matrix at a volume fraction of greater than 3% of the nanocomposite, wherein the bulk metal matrix nanocomposite is prepared by a process comprising:

forming a melt with the one or more metals;

introducing nanostructure material to the melt thereby forming a uniform, stabilized dispersion of the nanostructures in the melt; and cooling the melt to form a bulk metal matrix nanocomposite including the nanostructures uniformly dispersed therein, wherein the nanostructures are capable of being stably self-dispersed in the melt without ultrasonic processing of the melt, wherein the bulk metal matrix includes one or more metals selected from Al, Mg, Fe, Ag, Cu, Mn, Ni, Ti, Cr, Co, and Zn, and the nanocomposite meets formula (1) and/or formula (2):

$$|W_{vdwmax}|<kT \quad (1)$$

$$|[(A_{nanostructure})^{1/2}-(A_{matrix})^{1/2}]^2\times(1/12)\times(R/d_1)|<kT \quad (2),$$

wherein $A_{nanostructure}$ is the Hamaker constant of the nanostructure material, $A_{matrix}$ is the Hamaker constant of the bulk metal matrix material, T is a processing temperature of the melt;

R is an average effective radius of the nanostructures, $d_1$ is about 0.4 nm, and k is Boltzmann's constant.

2. The bulk metal matrix nanocomposite of claim 1, wherein the nanostructures have an average dimension in a range of 1 nm to 100 nm.

3. The bulk metal matrix nanocomposite of claim 1, wherein the nanostructures include a ceramic.

4. The bulk metal matrix nanocomposite of claim 3, wherein the ceramic is a transition metal-containing ceramic.

5. The bulk metal matrix nanocomposite of claim 4, wherein the transition metal-containing ceramic is selected from transition metal carbides, transition metal silicides, transition metal borides, and transition metal nitrides.

6. The bulk metal matrix nanocomposite of claim 1, wherein the nanostructures include a transition metal in elemental form.

7. The bulk metal matrix nanocomposite of claim 6, wherein the transition metal is W.

8. The bulk metal matrix nanocomposite of claim 1, wherein the volume fraction of the nanostructures in the bulk metal matrix nanocomposite is 5% or greater.

9. The bulk metal matrix nanocomposite of claim 1, wherein the volume fraction of the nanostructures in the bulk metal matrix nanocomposite is 10% or greater.

10. The bulk metal matrix nanocomposite of claim 1, wherein the matrix includes Al, and the nanostructures include a transition metal carbide or a transition metal boride.

11. The bulk metal matrix nanocomposite of claim 1, wherein the matrix includes Fe, and the nanostructures include a transition metal carbide, a transition metal boride, or a post-transition metal oxide.

12. The bulk metal matrix nanocomposite of claim 1, wherein the matrix includes Ag, and the nanostructures include a transition metal in elemental form.

13. The bulk metal matrix nanocomposite of claim 1, wherein the matrix includes Cu, and the nanostructures include a transition metal in elemental form or a transition metal carbide.

14. The bulk metal matrix nanocomposite of claim 1, wherein the matrix includes Zn, and the nanostructures include a transition metal in elemental form or a transition metal carbide.

15. The bulk metal matrix nanocomposite of claim 1, wherein the matrix includes Ti, and the nanostructures include a transition metal in elemental form or a transition metal silicide.

16. A bulk metal matrix nanocomposite article comprising:

a matrix including Al; and nanostructures uniformly dispersed in the matrix at a volume fraction of greater than 3% of the bulk metal matrix nanocomposite article, wherein the nanostructures include a transition metal carbide or a transition metal boride, and wherein the nanostructures are capable of being stably self-dispersed in a melt of the matrix without ultrasonic processing of the melt.

17. A bulk metal matrix nanocomposite article comprising:

a matrix including Al; and nanostructures uniformly dispersed in the matrix at a volume fraction of greater than 3% of the bulk metal matrix nanocomposite article, wherein the nanostructures include a nanostructure material, wherein formation of the bulk metal matrix nanocomposite comprises forming a melt of Al, and a contact angle θ of the melt of Al with a respect to a surface of the nanostructure material is less than 90°, wherein $|[(A_{nanostructure})^{1/2}-(A_{aluminum})^{1/2}]^2\times(1/12)\times(R/d_1)|<15.6$ zJ, and $A_{nanostructure}$ is the Hamaker constant of the nanostructure material, $A_{aluminum}$ is the Hamaker constant of Al, R is an average effective radius of the nanostructures, $d_1$ is 0.4 nm, and k is Boltzmann's constant, and wherein the nanostructures are capable of being stably self-dispersed in the melt without ultrasonic processing of the melt.

18. A bulk metal matrix nanocomposite article comprising:

a matrix including Fe; and nanostructures uniformly dispersed in the matrix at a volume fraction of greater than 3% of the bulk metal matrix nanocomposite article, wherein the nanostructures include a transition metal carbide, a transition metal boride, or a post-transition metal oxide, and wherein the nanostructures are capable of being stably self-dispersed in a melt of the matrix without ultrasonic processing of the melt.

19. A bulk metal matrix nanocomposite article comprising:

a matrix including Fe; and nanostructures uniformly dispersed in the matrix at a volume fraction of greater than 3% of the bulk metal matrix nanocomposite article, wherein the nanostructures include a nanostructure material, wherein formation of the bulk metal matrix nanocomposite comprises forming a melt of Fe, and a contact angle θ of the melt of Fe with a respect to a surface of the nanostructure material is less than 90°, wherein $|[(A_{nanostructure})^{1/2}-(A_{iron})^{1/2}]^2\times(1/12)\times(R/d_1)|<27.8$ zJ, and $A_{nanostructure}$ is the Hamaker constant of the nanostructure material, $A_{iron}$ is the Hamaker constant of Fe, R is an Aron average effective radius of the nanostructures, $d_1$ is 0.4 nm, and k is Boltzmann's constant, and wherein the nanostructures are capable of being stably self-dispersed in the melt without ultrasonic processing of the melt.

20. A bulk metal matrix nanocomposite article comprising:

a matrix including Ag; and nanostructures uniformly dispersed in the matrix at a volume fraction of greater than 3% of the bulk metal matrix nanocomposite article, wherein the nanostructures include a transition metal in elemental form, and wherein the nanostructures are capable of being stably self-dispersed in a melt of the matrix without ultrasonic processing of the melt.

21. A bulk metal matrix nanocomposite article comprising:

a matrix including Ag; and nanostructures uniformly dispersed in the matrix at a volume fraction of greater than 3% of the bulk metal matrix nanocomposite article, wherein the nanostructures include a nanostructure material, wherein formation of the matrix nanocomposite comprises forming a melt of Ag, and a contact angle θ of the melt of Ag with a respect to a surface of the nanostructure material is less than 90°, wherein $|[(A_{nanostructure})^{1/2}-(A_{silver})^{1/2}]^2\times(1/12)\times(R/d_1)|<19.8$ zJ, and $A_{nanostructure}$ is the Hamaker constant of the nanostructure material, $A_{silver}$ is the Hamaker constant of Ag, R is an average effective radius of the nanostructures, $d_1$ is 0.4 nm, and k is Boltzmann's constant, and wherein the nanostructures are capable of being stably self-dispersed in the melt without ultrasonic processing of the melt.

22. A bulk metal matrix nanocomposite article comprising:

a matrix including Cu; and nanostructures uniformly dispersed in the matrix at a volume fraction of greater than 3% of the bulk metal matrix nanocomposite article, wherein the nanostructures include a nanostructure material, wherein formation of the matrix nanocomposite comprises forming a melt of Cu, and a contact angle θ of the melt of Cu with a respect to a surface of the nanostructure material is less than 90°, wherein $|[(A_{nanostructure})^{1/2}-(A_{copper})^{1/2}]^2\times(1/12)\times(R/d_1)|<21.5$ zJ, and $A_{nanostructure}$ is the Hamaker constant of the nanostructure material, $A_{copper}$ is the Hamaker constant of Cu, R is an average effective radius of the nanostructures, $d_1$ is 0.4 nm, and k is Boltzmann's constant, and wherein the nanostructures are capable of being stably self-dispersed in the melt without ultrasonic processing of the melt.

23. A bulk metal matrix nanocomposite article comprising:

a matrix including Zn; and nanostructures uniformly dispersed in the matrix at a volume fraction of greater than 3% of the bulk metal matrix nanocomposite article, wherein the nanostructures include a transition metal in elemental form or a transition metal carbide, and wherein the nanostructures are capable of being stably self-dispersed in a melt of the matrix without ultrasonic processing of the melt.

24. A bulk metal matrix nanocomposite article comprising:

a matrix including Zn; and nanostructures uniformly dispersed in the matrix at a volume fraction of greater than 3% of the bulk metal matrix nanocomposite article, wherein the nanostructures include a nanostructure material, wherein formation of the bulk metal matrix nanocomposite article comprises forming a melt of Zn, and a contact angle θ of the melt of Zn with a respect to a surface of the nanostructure material is less than 90°, wherein $|[(A_{nanostructure})^{1/2}-(A_{zinc})^{1/2}]^2\times(1/12)\times(R/d_1)|<12.3$ zJ, and $A_{nanostructure}$ is the Hamaker constant of the nanostructure material, $A_{zinc}$ is the Hamaker constant of Zn, R is an average effective radius of the nanostructures, $d_1$ is 0.4 nm, and k is Boltzmann's constant, and wherein the nanostructures are capable of being stably self-dispersed in the melt without ultrasonic processing of the melt.

25. A bulk metal matrix nanocomposite article comprising:

a matrix including Ti; and nanostructures uniformly dispersed in the matrix at a volume fraction of greater than 3% of the nanocomposite, wherein the nanostructures include a transition metal in elemental form or a transition metal silicide, and wherein the nanostructures are capable of being stably self-dispersed in a melt of the matrix without ultrasonic processing of the melt.

26. A bulk metal matrix nanocomposite article comprising:

a matrix including Ti; and nanostructures uniformly dispersed in the matrix at a volume fraction of greater than 3% of the nanocomposite, wherein the nanostructures include a nanostructure material, wherein formation of the bulk metal matrix nanocomposite article comprises forming a melt of Ti, and a contact angle θ of the melt of Ti with a respect to a surface of the nanostructure material is less than 90°, wherein $|[(A_{nanostructure})^{1/2}-(A_{titanium})^{1/2}]^2\times(1/12)\times(R/d_1)|<29.5$ zJ, and $A_{nanostructure}$ is the Hamaker constant of the nanostructure material, $A_{titanium}$ is the Hamaker constant of Ti, R is an average effective radius of the nanostructures, $d_1$ is 0.4 nm, and k is Boltzmann's constant, and wherein the nanostructures are capable of being stably self-dispersed in the melt without ultrasonic processing of the melt.

27. A manufacturing method comprising:

heating one or more metals to form a melt;

introducing nanostructures into the melt thereby forming a uniform, stabilized dispersion of nanostructures in molten metal;

casting the melt into a mold; and cooling the melt to form a bulk metal matrix nanocomposite article including the nanostructures uniformly dispersed therein, wherein the volume fraction of the nanostructures uniformly dispersed in the bulk metal matrix nanocomposite article is greater than 3%, and wherein the nanostructures are capable of being stably self-dispersed in the melt without ultrasonic processing of the melt.

28. The method of claim 27, wherein the one or more metals are selected from Al, Mg, Fe, Ag, Cu, Mn, Ni, Ti, Cr, Co, and Zn.

29. The method of claim 27, wherein the nanostructures have an average dimension in a range of 1 nm to 100 nm.

30. The method of claim 27, wherein the nanostructures include a ceramic or a transition metal in elemental form.

31. The method of claim 27, wherein the volume fraction of the nanostructures uniformly dispersed in the bulk metal matrix nanocomposite article is 5% or greater.

32. The method of claim 27, wherein the volume fraction of the nanostructures uniformly dispersed in the bulk metal matrix nanocomposite article is 10% or greater.

33. The bulk metal matrix nanocomposite of claim 1, wherein a contact angle θ of the melt of the one or more metals with a respect to a surface of the nanostructure material is less than 90°.

* * * * *